US012439989B2

(12) United States Patent
Von Dunten et al.

(10) Patent No.: US 12,439,989 B2
(45) Date of Patent: Oct. 14, 2025

(54) LINER

(71) Applicant: ABUS August Bremicker Söhne KG, Wetter-Volmarstein (DE)

(72) Inventors: Marc Von Dunten, Essen (DE); Lukas Tamajka, Herdecke (DE); Matthias Ocklenburg, Mühltal Traisa (DE)

(73) Assignee: ABUS August Bremicker Söhne KG, Wetter-Volmarstein (DE)

( * ) Notice: Subject to any disclaimer, the term of this patent is extended or adjusted under 35 U.S.C. 154(b) by 56 days.

(21) Appl. No.: 18/335,165

(22) Filed: Jun. 15, 2023

(65) Prior Publication Data

US 2024/0016250 A1 Jan. 18, 2024

(30) Foreign Application Priority Data

Jul. 12, 2022 (DE) ..... 102022117398.4

(51) Int. Cl.
*A42B 3/10* (2006.01)
*A42B 3/06* (2006.01)

(52) U.S. Cl.
CPC ..... *A42B 3/10* (2013.01); *A42B 3/066* (2013.01)

(58) Field of Classification Search
CPC ..... A42B 3/28; A42B 3/066; A42B 3/064; A42B 3/32; A42B 3/147; A42B 3/14; A42B 3/10; A42B 3/324
See application file for complete search history.

(56) References Cited

U.S. PATENT DOCUMENTS

| | | | | |
|---|---|---|---|---|
| 341,365 A | | 5/1886 | Wilson | |
| 2,735,099 A | * | 2/1956 | Lewis | A42B 3/14 2/416 |
| 3,116,490 A | | 1/1964 | Zbikowski | |
| 3,497,874 A | | 3/1970 | Molitoris | |
| 3,613,114 A | * | 10/1971 | Hill et al. | A42B 3/10 2/416 |
| 3,711,864 A | * | 1/1973 | Dickstein | A42B 3/14 2/416 |
| 3,897,596 A | * | 8/1975 | Aileo | A42B 3/14 2/420 |
| 4,012,794 A | | 3/1977 | Nomiyama | |

(Continued)

FOREIGN PATENT DOCUMENTS

| | | |
|---|---|---|
| DE | 8804821 U1 | 6/1988 |
| DE | 102010050678 B3 | 4/2012 |

(Continued)

OTHER PUBLICATIONS

English translation of KR 20100126978 to Kim, obtained via espacenet.com (last visited Dec. 31, 2024). (Year: 2024).*

(Continued)

*Primary Examiner* — Patrick J. Lynch
(74) *Attorney, Agent, or Firm* — Dickinson Wright PLLC

(57) ABSTRACT

A liner for insertion into a concavely curved inside of an associated protective helmet, in particular a bicycle helmet, which extends along a longitudinal direction from a front side to a rear side, comprises at least two anchoring points for anchoring the liner to the protective helmet. The liner is also configured to be put under a shear stress along the inside of the protective helmet by the anchoring and to thereby assume a predetermined curved contour.

17 Claims, 9 Drawing Sheets

(56) References Cited

U.S. PATENT DOCUMENTS

| | | | | |
|---|---|---|---|---|
| 4,035,847 | A * | 7/1977 | Prince | A42B 3/14 2/416 |
| 5,068,922 | A * | 12/1991 | Zahn | A42B 3/14 2/416 |
| 5,774,901 | A * | 7/1998 | Minami | A42B 3/147 2/421 |
| 5,794,270 | A | 8/1998 | Howat | |
| 6,266,827 | B1 | 7/2001 | Lampe et al. | |
| 6,658,671 | B1 | 12/2003 | Von Holst et al. | |
| 2001/0032351 | A1 | 10/2001 | Nakayama et al. | |
| 2003/0070209 | A1 | 4/2003 | Falone et al. | |
| 2004/0117896 | A1 | 6/2004 | Madey et al. | |
| 2004/0168246 | A1 | 9/2004 | Phillips | |
| 2004/0199981 | A1 | 10/2004 | Tucker | |
| 2004/0250340 | A1 | 12/2004 | Piper et al. | |
| 2004/0255370 | A1* | 12/2004 | Moeller | A42B 3/145 2/416 |
| 2005/0262619 | A1 | 12/2005 | Musal et al. | |
| 2007/0192943 | A1 | 8/2007 | McDuff | |
| 2007/0265556 | A1 | 11/2007 | Monk et al. | |
| 2012/0060251 | A1 | 3/2012 | Schimpf | |
| 2013/0040524 | A1 | 2/2013 | Halldin et al. | |
| 2013/0042397 | A1 | 2/2013 | Halldin | |
| 2013/0122256 | A1 | 5/2013 | Kleiven et al. | |
| 2015/0089725 | A1 | 4/2015 | Lowe et al. | |
| 2015/0096113 | A1* | 4/2015 | Garneau | A42B 3/062 2/414 |
| 2018/0027913 | A1 | 2/2018 | Thiel | |
| 2018/0168268 | A1 | 6/2018 | Grinneback et al. | |
| 2018/0192730 | A1* | 7/2018 | Creak | A42B 3/322 |
| 2018/0303189 | A1 | 10/2018 | Hallander | |
| 2018/0345651 | A1 | 12/2018 | Polit Casillas et al. | |
| 2020/0113267 | A1* | 4/2020 | Light | B33Y 40/20 |
| 2021/0378344 | A1 | 12/2021 | Abram | |
| 2021/0378345 | A1 | 12/2021 | Pietrzak et al. | |
| 2022/0031005 | A1 | 2/2022 | Pietrzak et al. | |
| 2022/0232925 | A1 | 7/2022 | Pomering | |
| 2022/0354202 | A1 | 11/2022 | Halldin et al. | |
| 2023/0248103 | A1 | 8/2023 | Pomering | |
| 2025/0031796 | A1* | 1/2025 | Storey | A42B 3/062 |

FOREIGN PATENT DOCUMENTS

| | | | | |
|---|---|---|---|---|
| EP | 0954993 | A2 | 11/1999 | |
| EP | 2428129 | A2 | 3/2012 | |
| KR | 20100126978 | A * | 12/2010 | A42B 3/08 |

OTHER PUBLICATIONS

Abus Padding M Black AirBreaker; Available 2018; Retrieved Aug. 30, 2023; https://www.galaxus.ch/de/s3/product/abus-padding-m-black-airbreaker-velohelm-13815434; https:www.oxygenbikes/com/product/abus-airbreaker-replacement-pads-kit-406974-1.htm and located in "Mobile Sicherheit Katalog 2020 International" = "Mobile Security Catalogue 2020 International" as Katalog_MoSi_Gesarnt_2020_DE title page, pp. 4, 204-209, cover page; English version included.

Abus Padding M Black AirBreaker; 2018; No further information or English abstract available.

* cited by examiner

LINER

CROSS-REFERENCE TO RELATED APPLICATION

This application claims the benefit and priority of German Patent Application No. DE 102022117398.4 filed on Jul. 12, 2022. The entire disclosure of the above application is incorporated herein by reference.

FIELD

The present invention relates to a liner for insertion into a concavely curved inside of an associated protective helmet, in particular a bicycle helmet, which extends along a longitudinal direction from a front side to a rear side.

BACKGROUND OF THE INVENTION

A protective helmet may generally serve to protect the head of a wearer, for example a cyclist, in the event of an impact. For this purpose, protective helmets usually have a helmet body which may absorb kinetic energy acting on the protective helmet by inelastic and/or elastic deformation and thereby prevent direct transmission of the forces to the head of the wearer. In addition, an inside of protective helmets or their helmet body which faces the head of the wearer, is usually configured with a concave curvature such that the protective helmet may enclose in sections the head of the wearer.

Furthermore, protective helmets may be provided with insertable liners on the inside facing the head of the wearer, which in particular may promote an additional protective effect and/or increase the wearing comfort of the helmet. For example, provision may be made for the use of padding on the inside of the protective helmet which, on the one hand, may serve to absorb kinetic energy by elastic deformation in the event of an impact, yet on the other hand, may also enable the protective helmet to be worn more comfortably. Such liners, for example, may allow moisture to be transported from the wearer's head to the outside in order to enable improved cooling and, in turn, comfortable wearing of the protective helmet. Furthermore, a cooling may also be supported by configuring the protective helmets with ventilation channels through which air may flow along a wearer's head, for example while riding a bicycle, in order to allow for improved heat dissipation.

However, insertable liners for protective helmets are often very complex both to manufacture and to fit, since the concavely curved inside of the associated protective helmet needs to be accurately replicated and the liner needs to be correctly mounted to such a curved inside. Moreover, in the case of protective helmets having the ventilation channels already mentioned which have channel-like recesses over the curved shaped inside, the ventilation channels of the liner must also be replicated as far as possible so as to not interrupt an airflow flowing along the head through the ventilation channels when the liner is inserted into the inside. However, any such deviations from a concavely curved shape further complicate in particular the manufacture of the liner, which must be manufactured with a correspondingly more complex shape. In addition, provision may also be made for the liner to be able to be selectively detached from the protective helmet in order to be able to clean it or replace it as a result of wear, for example, so that also the insertion and/or removal of the liner is to be made as uncomplicated as possible.

SUMMARY OF THE INVENTION

It is therefore an object of the invention to provide a liner for insertion into a concavely curved inside of an associated protective helmet, which allows a simple manufacture and an easy insertion into the protective helmet and, in particular, allows ventilation through the ventilation channels arranged in the protective helmet to be maintained.

This object is achieved by a liner having the features of claim 1.

The object is thus achieved, in particular, by the liner comprising at least two anchoring points for anchoring the liner to the protective helmet and by being configured to be put under tension along the inside of the protective helmet by the anchoring, and to thereby assume a predetermined curved contour.

In that the liner comprises two anchoring points for anchoring it to the protective helmet and in that it may be put under shear stress along the inside of the protective helmet by the anchoring, the liner may be transferred into the predetermined curved contour immediately during insertion into the protective helmet and, in particular, be transferred into a contour corresponding to or associated with the concavely curved inside of the associated protective helmet. Therefore, in particular, the liner must not necessarily be originally manufactured with a shape corresponding to the concavely curved inside of the associated protective helmet, but rather, may also be manufactured, for example, in a flat base shape, in order to assume the predetermined curved contour only as a result of anchoring.

In particular, the predetermined curved contour may correspond to a contour of the concavely curved inside of the associated protective helmet or may replicate the concavely curved inside. For example, the inside of the protective helmet may have a substantially spherical segmented shape in order to replicate as much as possible a head shape of a wearer, and so by the anchoring process, the liner may also be brought into a shape, in particular, into a substantially spherical segmented shape.

However, where appropriate, the associated protective helmet may also comprise ventilation channels which may extend along the longitudinal direction of the protective helmet and may form recesses over the curved shape of the inside and, in particular, over a spherical segmented shape. Thus, the liner may be configured to be brought into a predetermined contour by the anchoring which takes the ventilation channels into account, so that, in particular, the liner in the anchored state may also have deviations from a spherical segmented shape. In order to take the ventilation channels into account, the liner may in particular comprise sections which, as a result of the anchoring, are urged radially outwardly with respect to a spherical segmented shape, in order to be able to engage in the ventilation channels. Such radially outwardly urged sections may replicate a shape, in particular, a cross-sectional shape of the ventilation channels, for example, so that the sections may line the ventilation channels to a certain extent, wherein, however, the outwardly urged sections may also have a shape, in particular a cross-sectional shape, that differs from the ventilation channels. Independent of the exact shape of the outwardly urged sections in the anchored state, through such sections of the liner it may be ensured that a free space remains between the liner and a wearer's head in the region of the ventilation channels, which allows an airflow along the head of the wearer through the ventilation channels.

In order to be able to place the liner under shear stress, the at least two anchoring points may be spaced from one another, in particular along the longitudinal direction and/or transversely, in particular perpendicular to the longitudinal direction, so that the liner may be tensioned in the protective helmet by the anchoring. For this purpose, a distance between the anchoring points in the anchored state may in particular be smaller than in the non-anchored state of the liner, so that the liner in the anchored state may be subjected to a compressive force between the anchoring points. In addition, the liner may have a stiffness in its base shape but be configured to be elastically flexible, wherein the stiffness may counteract the transfer into the predetermined contour and, to an extent, may tension the liner in its base shape in the non-anchored state, so that the liner may overall be put under tension by the anchoring and tensioned in the protective helmet. Thereby, as a result of the anchoring, sections of the liner that in particular do not lie between the anchoring points may also be urged radially outwardly with respect to a spherical segmented shape and thus against the curved inside of the protective helmet, in order to tension the liner completely in the protective helmet.

The anchoring points may be formed, for example, by anchoring openings through which anchoring means, in particular screws for example, may be passed through, in order to anchor the liner to the protective helmet. To make this possible, anchoring recesses corresponding for example to the anchoring points may be provided on the associated protective helmet, so that the anchoring means may be introduced through the anchoring points of the liner into the anchoring recesses of the protective helmet, in order to anchor the liner. Generally, however, the anchoring points may also be formed by adhesive points defined on the liner or by projections formed on the liner which are configured to engage with associated openings on the inside of the associated protective helmet, in order to anchor the liner.

The liner may also be configured in particular to be put under shear stress along a transverse direction by the anchoring and thereby assume a predetermined contour along the transverse direction, wherein the transverse direction may in particular be oriented perpendicular to the longitudinal direction. This will be explained in further detail below.

In summary, the liner thus may be tensioned along the inside of the protective helmet by the anchoring in the protective helmet, in that a shear stress is generated between the anchoring points. Due to this shear stress, a compressive force may be exerted on the liner between the anchoring points, in order to shape the liner and bring it into the predetermined curved contour, in particular to bend it. Since this shear stress is generated directly by or as a result of the anchoring, the concavely curved inside of the protective helmet may be replicated during the insertion of the liner, without the need for the liner to already have the predetermined curved contour and to be manufactured with the predetermined contour. In addition, anchoring the liner at two, in particular only two, anchoring points allows the liner to be inserted and removed easily, so that also a replacement of the liner may be carried out in a simple manner.

The associated protective helmet, in which the liner is insertable, may in particular comprise a helmet body, which may, for example, be made of EPS (expanded polystyrene) and be intended to absorb kinetic energy in the event of an impact by elastic and/or inelastic deformation. In addition, the protective helmet may comprise an outer shell attached to such a helmet body and in particular firmly connected with the helmet body, which may be made of polycarbonate, for example. The outer shell may be arranged on an outer side of the helmet body facing away from the head of the wearer. In addition, the protective helmet may comprise, for example, a chin strap and/or a neck strap to enable the protective helmet to be securely held on a head of the wearer and to allow the protective helmet to be adapted, for example, to different sizes. The protective helmets into which the liner is insertable, may be, in particular, bicycle helmets, whereby for example, also other sports helmets, for example riding helmets, may also be considered.

The inside of the protective helmet is to be understood within the context of the invention as that side of the protective helmet which faces the head of the wearer during wearing. Accordingly, the outside of the protective helmet is to be understood as that side of the protective helmet which faces away from the head of the wearer during wearing. Liners within the meaning of the present disclosure may also be referred to as inner shell or lining, as appropriate.

Further embodiments of the invention may be found in the dependent claims, the description and the drawings.

In some embodiments, the at least two anchoring points may be spaced from each other along a transverse direction running perpendicular to the longitudinal direction.

By the anchoring points being arranged in such a manner, in particular a shear stress may be generated which, with respect to the superordinate protective helmet, points from the outer sides of the helmet towards the center of the inside of the protective helmet, i.e. in particular not, or in any case not exclusively, from the front side and the rear side towards the center of the inside. The liner may thus be urged into the protective helmet, in particular towards the center of the inside of the protective helmet and tensioned into a curved shape, whereby a stiffness of the liner may counteract this tension and thereby urge the liner as a whole outwardly against the inside of the protective helmet. In order to generate the shear stress, the distance between the anchoring points along the transverse direction in the unanchored state or in a base shape of the liner, in particular may be greater than in the anchored state of the liner when the liner assumes the predetermined curved contour.

Due to the spaced arrangement of the anchoring points along the transverse direction, it may also be taken into account the fact that a curvature on the inside of the associated protective helmet is usually stronger along the transverse direction than along the longitudinal direction in order to be able to replicate accordingly the elongated head shapes. Due to this stronger curvature along the transverse direction compared to the longitudinal direction, also a greater shear stress may be transferred to the liner along the transverse direction through corresponding spacing of the anchoring points in order to be able to transfer the liner into the predetermined curved contour.

In general, in some embodiments, it may however also be provided for, that the at least two anchoring points are spaced from each other along the longitudinal direction, in order to be able to generate a shear stress directed from the front side and the back side towards the center of the inside of the protective helmet and being able to thereby urge the liner into the predetermined curved contour. Furthermore, in some embodiments, the at least two anchoring points may be arranged spaced from each other along both the longitudinal direction and the transverse direction, in order to be able to generate a shear stress oriented obliquely to the longitudinal direction and to be able to bring the liner into the predetermined contour.

In some embodiments, the liner may have a substantially planar base shape and may be configured to be tensioned by the anchoring into a curved helmet shape, in particular, a substantially spherical segmented shape.

In particular, such a substantially planar base shape enables simple manufacture of the liner, in that the liner may be manufactured as planar without needing to replicate the concavely curved shape of the inside already in the base shape. Rather, such a replica of the curved shape of the inside may take place during the anchoring of the liner to the inside of the protective helmet and thus during the insertion of the liner, in that the liner is put under shear stress by the anchoring and is transferred into the predetermined curved contour along the inside. Furthermore, a liner configured with a planar base shape may have a stiffness that must be overcome during the anchoring and the transferring of the liner into the predetermined contour, in order to generate a tension in the liner and to tension the liner in the protective helmet. The liner may be bent in embodiments with a planar base shape, in particular into the predetermined contour.

In some embodiments, the liner may comprise a plurality of recesses. The recesses may extend substantially radially outwards from a central section of the liner. Furthermore, the recesses may be circumferentially closed or open, wherein the recesses may be configured to be open in particular at their radially outer ends. In particular, such recesses may make it possible, starting from a planar base shape of the liner, to achieve approximation to a spherical or spherical segmented helmet shape without any material overlap, when a liner with a substantially planar base shape is brought into the predetermined curved contour by anchoring.

In some embodiments, the liner may comprise at least one bridge section which is configured to be urged into a bridge shape by the shear stress, in order to engage with an associated ventilation channel of the protective helmet.

In particular, such a bridge shape may represent a bulge that may be directed radially outwards with respect to the predetermined contour of the liner, in particular, the curved inside of the protective helmet and/or a spherical segmented shape. By the at least one bridge section being configured so as to be urged into a bridge shape by the shear stress, the bridge section may engage in the associated ventilation channel of the protective helmet, so that the ventilation channel is not covered despite there being the inserted liner, but rather, air may continue to flow through the ventilation channel between the head of a wearer and the inside of the protective helmet or the inserted liner. The bridge section may thus form a deviation from an otherwise substantially spherical segmented contour of the liner in the anchored state.

Thus, in some embodiments, the at least one bridge section may be configured to form a radially outwardly directed bulge in the predetermined curved contour.

In a base shape of the liner or in its non-anchored state, the bridge section may in particular connect two support sections of the liner with each other, the support sections being spaced from each another transverse to the longitudinal direction and extending along the longitudinal direction. Furthermore, in the non-anchored state of the liner, the bridge section may also have a planar base shape in order to be urged into the bridge shape only by the shear stress or the anchoring of the liner and to be able to engage in a ventilation channel. Moreover, in the anchored state, the bridge section may replicate a cross-sectional shape of the ventilation channel or indeed allow air to flow through the ventilation channel along a head of a wearer of the protective helmet while however having a cross-sectional shape that is different from the cross-sectional shape of the ventilation channel. This will be explained in further detail below.

The associated protective helmet may furthermore comprise a plurality of ventilation channels on the inside, wherein the liner may comprise, in particular for each of the ventilation channels, an associated bridge section which may be urged by the shear stress into a bridge shape in order to engage in the respective associated ventilation channel. The ventilation channel or channels may extend along the longitudinal axis of the protective helmet, in particular, on the inside thereof, in order to allow a flow of air at the head of a wearer of the protective helmet along the longitudinal axis.

In addition, the bridge sections make it possible to introduce excess material, to an extent, along the inside of the protective helmet compared to a purely spherical segmented shape, so that the liner may be movable relative to the protective helmet or its inside, in particular a helmet body forming the inside, by the moving of the bridge sections out of the ventilation channels, at least in sections. In particular, this may allow the liner to slide along the inside in the event of an impact, whereby tangential force components oriented along the curved inner surface and/or rotational force components may be absorbed and a direct transfer to a wearer's head may be prevented.

In some embodiments, the liner may further comprise at least two folds which restrict the bridge section and predetermine a respective fold line in order to form the bridge shape.

In particular, the at least two folds may be arranged in such a way that the respective bridge section may be forced into the bridge shape by a force component which is exerted by said shear stress along the extension plane of the liner perpendicular to the respective extension direction of the folds, when the liner is anchored to the protective helmet. Furthermore, the at least two folds may be arranged in such a way that the bridge section in particular fits into the concave cross-section of the ventilation channel of the liner, as a result of said force component when the liner is anchored. Moreover, the folds may be configured, in particular, in the manner of a film hinge.

Further, it may be provided for that the two folds extend substantially parallel to each other. For example, the folds may extend substantially along the longitudinal direction in order to be acted upon and caused to bend by a shear stress oriented transverse to the longitudinal direction and towards a center of the inside of the protective helmet, so that the bridge shape may be formed and the bridge section may be urged outwardly. In particular, this may be provided for such helmet liners in which the anchoring points are arranged spaced from each other with respect to a transverse direction oriented perpendicular to the longitudinal direction, so that a shear stress may be exerted from outer sides of the liner with respect to the transverse direction towards the center of the inside of the protective helmet. Alternatively, the folds may, however, also be oriented transverse and, in particular, perpendicular to the longitudinal direction, wherein this may be provided in particular in embodiments in which the anchoring points are spaced from each other in the longitudinal direction.

The folds may be configured as bends or kinks. In addition, in some embodiments, at least one fold of the at least two folds may be perforated and/or grooved, wherein, in particular, both folds of the at least two folds may be perforated and/or grooved. Moreover, in some embodiments, at least one of the at least two folds may have a perforation and/or a groove, in particular both of the at least two folds.

Such a groove or perforation may present a deliberate weakening of the material due to which the folds which in turn define fold lines along which the bridge sections bend due to the anchoring of the liner as a result of the generated shear stress, may tear or tear off in the event of an impact, in order to be able to absorb or weaken the occurring translational and/or rotational force components of a force acting on the protective helmet. For example, such tearing of the folds may allow the liner to move relative to the inside of the protective helmet and hence allow the liner to slide along the inside of the protective helmet in order to thereby absorb said force components and prevent direct transmission to a wearer's head. In addition, also due to the tearing of the folds themselves a portion of the force components may already be absorbed, so as to protect the head of the wearer from the effect of such force components. Furthermore, force values of tangential and/or rotational force components at which absorption due to the tearing of the folds occurs, may be specifically defined by a suitable perforation and/or groove.

In particular, perforated or grooved folds may be outer folds, explained in more detail below, which confine a bridge section. Inner folds, on the other hand, which are also explained in more detail below, may in particular have no perforations or grooves, but rather be configured merely as bends or continuous fold lines. Generally, however, it is also possible for inner folds to also have perforation or grooving.

In some embodiments, the folds may confine one or more bridge sections in respective pairs. In this respect, a respective pair of folds may be associated with the bridge section or, in embodiments having a plurality of bridge sections, a respective pair of folds may be associated with each bridge section, said folds outwardly confining the bridge section and separating it from other sections of the liner, in particular the aforementioned support sections. In such embodiments, the folds may thus form outer folds which limit the bridge section extending between the folds. In particular, in the anchored state, the folds may be arranged at an edge of the ventilation channel facing the head of the wearer and form a bend from which the bridge section in the bridge form extends into the ventilation channel.

Furthermore, in some embodiments, the at least one bridge section may comprise at least one inner fold which is arranged between the outer folds which confine the bridge section. Such an inner fold or folds, may in particular define further fold lines that may determine the bridge shape. For example, a single inner fold extending centrally between and parallel to the outer folds, may determine a triangular bridge shape, whereas two inner folds may form fold lines to create a rectangular bridge shape, for example. In addition, a plurality of inner folds may, for example, enable the bridge section to be urged into an accordion shape, at least in sections, by the shear stress. This is also explained in more detail below.

In some embodiments, the liner may comprise at least two bridge sections, wherein each of the at least two anchoring points may be arranged on one of the at least two bridge sections.

In such embodiments, the liner may thus be connected to the protective helmet at the bridge sections and mounted to the inside of the protective helmet, wherein the liner may be anchored in particular to a channel base of the respective associated ventilation channels facing away from the head of the wearer. In particular, the anchoring points may be arranged at the center of the respective bridge section with respect to a transverse direction oriented perpendicular to the longitudinal direction, so that in particular the liner may also be fixed to the inside of the protective helmet at the center of the ventilation channels.

Furthermore, in some embodiments, one or more further bridge sections may be arranged between the two anchoring points at which no anchoring point is configured. Thus, these further bridge sections may be urged by the shear stress into a respective associated ventilation channel, but without being anchored there. The further bridge sections are therefore not fixed to the liner and are, to some extent, mounted in a floating manner, so that, in particular, the further bridge sections may be movable out of the associated ventilation channels. This allows the liner to slide between the anchoring points relative to the protective helmet along the inside thereof, in order to be able to prevent a transmission of tangential or rotational force components directly to the head of a wearer.

Furthermore, in some embodiments, each of the at least two anchoring points may be arranged at a respective bulge section of the at least two bridge sections, wherein the bulge sections of the at least two bridge sections may be destined to abut a channel base of the associated ventilation channel of the protective helmet.

In particular, the channel base of the ventilation channel may face away from the head of the user. Whilst the liner may be anchored to the channel bases of respective ventilation channels, the anchored bridge sections may extend with the bulge sections to the channel bases of the respective ventilation channels, so that the ventilation channels are not blocked by the liner and in particular by the bridge sections, but rather an airflow may flow through the ventilation channels as undisturbed as possible despite the mounting of the liner.

In some embodiments, the at least one bridge section may include a tongue at which the anchoring point is arranged. The tongue may extend in particular along the longitudinal direction and/or be formed by a material recess at the bridge section, in particular by a bulge section of the bridge section, so that the anchoring point may be arranged at a narrower section of the bridge section compared to a maximum extension of the bridge section, in particular in the transverse direction.

By forming the anchoring point on such a tongue, it can be achieved that the bridge section is not completely tensioned or pressed in the ventilation channel in the anchored state, but that relative rotational movements may take place between the liner and the inside of the protective helmet. In particular, this makes it possible to not transmit tangential or rotational force components directly to a head of the wearer of the protective helmet in the event of an impact, but rather to already absorb or weaken them by the relative rotation of the liner to the protective helmet. In doing so, the liner may slide in particular along the inside of the protective helmet during such rotations in order to absorb rotational forces. The aforementioned rotational movements between the liner and the protective helmet due to the arrangement of the anchoring point on a tongue of the bridge section may involve, in particular, only minor rotational movements by a few degrees, for example by a maximum of 10° or by a maximum of 5°.

In some embodiments, the liner may include at least one bridge section between the at least two anchoring points on which no anchoring point is arranged.

In such embodiments, the liner may therefore have, in particular, at least one bridge section mounted in a floating manner which is not fixed at any point to the protective helmet, but is urged in the associated ventilation channel merely by the shear stress generated between the anchoring points. For example, a bridge section which is central with respect to a transverse direction oriented perpendicular to the longitudinal direction and which can be urged into a central ventilation channel of the associated protective helmet may have no anchoring point, but may be brought into a bridge shape and urged into the ventilation channel solely as a result of the pretension and/or by a bending of the folds of the bridge section. Furthermore, in such embodiments, the at least two anchoring points may be arranged at respective bridge sections, in particular outer bridge sections, or at other sections of the liner, for example the aforementioned support sections, between which the at least one bridge section is without an anchoring point is arranged.

In some embodiments, the at least one bridge section may be configured between two support sections of the liner which extend substantially along the longitudinal direction in the anchored state, wherein the at least one bridge section may connect the support sections in a bridge like manner.

In particular, the longitudinally extending support sections may form surfaces in the anchored state, which extend along the longitudinal direction between adjacent ventilation channels of the protective helmet and against which a head of the wearer can rest. The support sections can thereby form a padding for example, so as to enable comfortable wearing of the helmet and, in particular, enable further absorption of forces by elastic deformation in the event of an impact.

While the support sections may extend substantially along the longitudinal direction from the front of the helmet towards the rear in the anchored state, the bridge section or bridge sections may have a smaller longitudinal extension and may initially serve to connect the support sections with each other. In this respect, the liner may comprise recesses between adjacent support sections which are confined by the support sections and a bridge section. Furthermore, as already explained, the bridge sections, however, may also have the anchoring points and in this respect be provided for fixing the liner to the protective helmet.

In addition, the liner may comprise a curved front surface at a front side thereof, which is configured to extend in a curved manner at a front side of the associated protective helmet in the anchored state and, in particular, to form a forehead padding.

In some embodiments, the liner may comprise a plurality of bridge sections and a plurality of support sections. In some of these embodiments, the at least two anchoring points may be arranged at a respective bridge section. As explained above, the anchoring points may be provided in particular at respective bulge sections such that the liner may be anchored at the bridge sections and at a respective channel base of an associated ventilation channel.

Alternatively, in some embodiments, it may be provided for, that the at least two anchoring points may be arranged at a respective support section. In such embodiments, in particular, the plurality of bridge sections may be transferred into their bridge shape merely by the shear stress and may be urged into a respective associated ventilation channel, without, however, being fixed or anchored in the ventilation channel. In particular, such a floating mounting of the bridge sections allows a movement of the liner relative to the inside of the protective helmet, in that the bridge sections may be moved out of the ventilation channels. The liner can thereby slide relative to the inside of the protective helmet in the anchored state, in order to be able to at least partially absorb tangential or rotational force components.

Furthermore, in some embodiments, it may be provided for, that a first of the at least two anchoring points is arranged at a bridge section and a second of the at least two anchoring points is arranged at a support section. Such an arrangement of the anchoring points may also allow the liner to be put under shear stress, thereby bringing it into the predetermined curved contour.

Moreover, generally also more than one anchoring point, for example a front anchoring point and a rear anchoring point, may be provided at a bridge section and/or a support section. Thus, for example, two pairs of longitudinally spaced anchoring points may be provided, wherein these pairs may in turn be spaced from each other in a transverse direction perpendicular with respect to the longitudinal direction, in order to be able to generate a compression force oriented transverse to the longitudinal direction and/or oriented in the longitudinal direction and to be able to transfer the liner into the predetermined curved contour. Generally, however, it can also be provided for, that the liner has only two or exactly two anchoring points in order to enable the liner to be mounted to the protective helmet as easily as possible.

In some embodiments, the at least one bridge section may be connected to the support sections of the liner by outer folds. In particular, the folds may be configured to bend as a result of the shear stress and thereby transfer the bridge section into the aforementioned bridge shape, so that the bridge section may be urged into the associated ventilation channel.

In some embodiments, the at least one bridge section may have a bridge section length along the longitudinal direction, wherein a length of the outer folds along the longitudinal direction may correspond to the bridge section length. Alternatively, the length of at least one of the outer folds, but in particular both outer folds, may be less than the bridge section length and, for example, may correspond to half the bridge section length.

In particular, by choosing a reduced length of the folds compared to the bridge section length, a relative movability of the support sections connected to each other by the bridge section may be achieved, wherein a reduced length of the outer folds may allow deflections of the support sections and thereby, for example, allow rotational movements of the support sections relative to each other. In turn, this may serve in particular to prevent a direct transmission of rotational force components to the head of a wearer.

In some embodiments, the at least one bridge section may include at least one inner fold between the outer folds.

In particular, one or more such inner folds may serve to define the shape of the bridge section urged into the ventilation channel, so that the bridge shape of the bridge section may be predetermined by the number of and/or arrangement of the inner fold or folds. For example, the bridge section may comprise two inner folds which are configured to bend as a result of the shear stress and to separate sections of the bridge section extending along respective channel walls of the associated ventilation channel, from a section connecting these sections, which may extend in particular along a channel base of the associated ventilation channel. In doing so, it may for example be achieved, that the bridge shape replicates a cross-sectional shape of the associated ventilation channel and that the bridge section fits into the associated ventilation channel in the anchored state. Furthermore, the at least one bridge section may have, for example, an inner fold which extends along the longitudinal direction and parallel to the outer folds, so that the bridge section may be urged into a triangular bridge shape by bending this inner fold. A plurality of inner folds may also be provided, to create, for example, an accordion-like bridge shape. However, in some embodiments, the at least one bridge section may also have exclusively outer folds but no inner fold, whereby in particular a curved, in particular arcuate, bridge shape may be defined.

In some embodiments, in a cross-section of the associated protective helmet, a straight line connecting a center of a channel base of the associated ventilation channel and an edge of the associated ventilation channel facing the head of the wearer may define a channel diagonal, wherein a half of the distance between the outer folds may be greater than the channel diagonal. By such a selected distance between the outer folds, the bridge section may be urged on the channel base and anchored in the center of the channel base, wherein, however, the length of the material urged in the ventilation channel between the edge of the ventilation channel and the anchoring point is greater than the channel diagonal. In this respect, to some extent, excess material may be urged in the ventilation channel, due to which the anchored bridge section may in part be moved out of the ventilation channel in the event of an impact, and a sliding of the liner relative to the protective helmet may be possible.

In some embodiments, the liner may have a length between the at least two anchoring points including the at least one bridge section that is greater by at least 10%, in particular by at least 20%, than the length of the predetermined curved contour between the at least two anchoring points without taking into consideration the at least one bridge section. The length of the predetermined curved contour may in particular be defined by the course of a concavely curved base shape of the protective helmet, without taking into consideration the ventilation channels deviating from this base shape. By the at least one bridge section, the length of the liner between the anchoring points may thus be increased compared to the length of the predetermined curved contour so that a contact section of the liner, against which the wearer's head bears and against which a force transmission to the head occurs in the event of an impact, may slide along the inside of the protective helmet due to an unfolding of the bridge section, in order to prevent direct transmission of rotational or tangential force components to the head of the wearer and to absorb such forces.

In some embodiments, the at least one bridge section may be elastic with respect to force components oriented transversely, in particular perpendicularly, to the longitudinal direction. In particular the at least one bridge section may be elastic with respect to force components oriented tangentially along the inside of the protective helmet.

As explained above, such elasticity may be achieved, for example, by an excess of material against the concavely curved base shape of the protective helmet, which allows the at least one bridge section or a plurality of bridge sections to unfold or move out of the respective associated ventilation channels. Alternatively or additionally, the at least one bridge section, however, may also be formed from an elastic material, so that relative movement between the liner and the protective helmet may be possible by elastic deformation of the bridge section as a result of the application of a force to the protective helmet.

In some embodiments, the at least one bridge section may be configured to engage, at least in sections, in an accordion-shaped manner in the associated ventilation channel.

In particular, such a bridge section may comprise a plurality of the aforementioned inner folds in order to be able to create an accordion-shaped bridge shape by the bending of these folds as a result of the shear stress. In particular, such a bridge section may extend in an accordion shape along channel walls of the associated ventilation channel and have a connecting section which extends along the channel base connecting the accordion-shaped sections of the bridge section, on which in particular an anchoring point may be provided.

Such an accordion shape makes it possible in particular to substantially replicate the shape, in particular the cross-sectional shape, of the associated ventilation channel, so that an airflow guided through the ventilation channel may remain substantially unaffected by the bridge section being urged into it. However, due to the accordion shape, in particular a greater length of material may be urged into the ventilation channel along the channel walls compared to a length of the channel walls of the ventilation channel in the radial direction with respect to the curved helmet shape, so that the accordion-shaped sections may unfold in the event of an impact and the liner may move relative to the inside of the protective helmet, in particular between two anchoring points provided at respective bridge sections. Such an unfolding is also then possible, in particular, when the accordion-shaped bridge section itself is anchored at the channel base.

Alternatively or additionally, the at least one bridge section may be configured to engage, at least in sections, in a curved manner in the associated ventilation channel. For example, in the anchored state of the liner, the bridge section may be configured with a semi-circular or arcuate shaped cross-section in order to engage in a curved manner in the associated ventilation channel. In particular, such a bridge shape may be created if no inner folds are provided between the outer folds of the bridge section, so that the bridge section may only be bent at the outer folds and be put under shear stress between the outer folds. However, even such a curved configuration of the bridge section allows the liner to slide along the inside of the protective helmet, in that the curved bridge section is pulled apart as a result of tangential forces oriented along the inside and the bridge section is straightened.

Furthermore, in some embodiments, as an alternative or in addition to the shapes already mentioned, it may be provided for that the at least one bridge section is configured to engage in a triangular-shaped cross-section in the associated ventilation channel. For this purpose, in particular an inner fold extending between the outer folds and parallel to these outer folds may be provided, so that the outer folds may form bends of the bridge section at edges of the associated ventilation channel, whereas the inner fold may form a bend at a deepest point of the bridge section urged into the ventilation channel and a tip of a triangular shape. For example, an anchoring point may also be provided at such a bridge section, in particular at the tip of the triangular shape, whereby in this case, however, the length of the bridge section from the anchoring point to an outer fold of the bridge section may correspond to the length of a straight line connection between the anchoring point at the channel base of the ventilation channel and an edge facing the head of the wearer, so that excess material is not urged into the ventilation channel and the bridge section cannot be unfolded in order to allow the liner to slide. However, such a bridge section may, if applicable, be formed of an elastic material so that relative movement between the liner and the inside of the protective helmet generally may also be allowed by such a triangular-shaped bridge section.

In some embodiments, the at least one bridge section may alternatively or additionally also be configured to at least substantially replicate a cross-sectional shape of the associated ventilation channel when the liner is in the anchored state. In particular, the bridge section may extend for this purpose along channel walls and along the channel bottom of the associated ventilation channel and fit in the ventilation channel. Such a shape may be achieved, for example, by two inner folds, so that the bridge section may be urged by the shear stress into a rectangular or truncated-pyramid cross-sectional shape corresponding to the ventilation channel. Since also with such a bridge shape, a length of the bridge section from an anchoring point provided, if appropriate, to an outer fold may be greater than a straight line connection between the anchoring point and an edge of the associated ventilation channel, such a shaped bridge section also allows the bridge section to unfold and thereby allow the liner to slide along the inside of the protective helmet.

Generally, the liner may comprise a plurality of bridge sections, wherein, in the anchored state, the bridge sections may adopt the same bridge shape or have bridge shapes different from one another. For example, different bridge shapes may be used to influence differently an airflow flowing through the respective ventilation channels. In addition, the bridge shape may be used to specifically influence a sliding of the liner as a result of tangential and/or rotational force components occurring during an impact, so that, for example, areas of greater possible relative movements between the liner and the inside of the protective helmet and areas in which the liner cannot be moved or can only be moved slightly relative to the inside of the protective helmet, may be defined.

Further, in some embodiments, the at least one bridge section may have at least one buckling which is configured to form a buckled corner at an edge of the associated ventilation channel facing the head of the wearer in the anchored state. For example, in the anchored state of the liner, such a buckling can extend triangularly over an edge of the associated ventilation channel, so that in turn an excess of material is available in the region of the buckling, which allows a movement of the liner relative to the inside of the protective helmet, in particular a rotational relative movement. Such a buckling may be configured, for example, as a bulge at an outer fold of the bridge section which, in the anchored state of the liner, may extend in particular radially outwards with respect to the predetermined contour, but generally also radially inwards.

In some embodiments, the liner may have exactly two anchoring points for anchoring the liner. By means of these two anchoring points the required shear stress may in particular be generated, whereby, however, the liner only needs to be mounted at two anchoring points in order to be inserted into the protective helmet. In particular, this allows for easy and quick insertion or replacement of the liner.

Further, in some embodiments, the liner may have more than two anchoring points, in particular exactly three, exactly four, exactly five or exactly six anchoring points. Such a number of anchoring points may also reliably generate the required shear stress, whereby, in addition, a stronger mounting of the liner to the protective helmet may be achieved.

The anchoring points may be provided in a circumferential arrangement with respect to the longitudinal direction. In particular, the anchoring points may be spaced apart with respect to a transverse direction oriented perpendicular to the longitudinal direction.

In some embodiments, a surface of the liner facing the protective helmet in the anchored state may have a lower friction than a surface of the liner facing away from the protection helmet. In particular, this may reduce friction between the liner and the inside of the protective helmet in order to allow sliding of the liner and/or rotation of the liner relative to the inside of the protective helmet. To this end, the surface facing the protective helmet may be configured to be smooth, for example, while padding may be provided on a side facing the head of the wearer, for example. Alternatively or additionally, the inside of the associated protective helmet may also have a friction-reduced surface.

In some embodiments, the liner may have at least one mounting point for mounting the tensioned liner to the protective helmet, wherein, in the anchored state, the at least one mounting point may be arranged at the front or the back of the protective helmet. In particular, such a mounting point may be provided at a front side in order to be able to mount, for example, a front surface of the liner extending at the front side along the forehead of a wearer of the protective helmet, which may in particular form a padding for the forehead of the wearer. However, such a mounting point does not serve to tension the liner, but rather the liner may be tensioned via said anchoring points and brought into the predetermined curved contour.

In some embodiments, the liner may be configured as a single-piece. In particular, the liner may be configured integrally as a material fit.

However, in some embodiments, the liner may also be configured in multiple layers and include, for example, a first plastic layer to which a second layer and, for example, a padding may be mounted and, in particular, glued. Further, the liner may comprise, for example, a polycarbonate layer, a foam layer, and a fabric layer, wherein the polycarbonate layer may face, in particular, the inside of the protective helmet. The foam layer may be arranged on the polycarbonate layer and may be elastically deformable, for example, to form padding. The fabric layer may be arranged on the foam layer and face a head of the wearer in order to increase the wearing comfort of the protective helmet. In addition, in some embodiments, the fabric layer may surround the liner and/or a foam layer of the liner. The polycarbonate layer may further define the stiffness or inherent elasticity of the liner and/or have a reduced friction surface in order to support a sliding of the liner along the inside of the protective helmet. However, such a multi-layered liner may also be provided in a single-piece and be insertable as a single-piece into the protective helmet, so that the liner does not have to be initially assembled from multiple pieces or multiple pieces need to be individually inserted into the protective helmet. Multi-layered helmet liners may also be referred to as multi-layered liners.

In some embodiments, the liner may be configured to be elastically flexible. In such embodiments, the liner may consequently have a basic stiffness with resilient behavior when bent, in order to be able to be tensioned in the protective helmet along the inside thereof. However, the liner may have a lower or substantially no restoring moment at the aforementioned folds, so that the bridge sections may be urged into their respective bridge shapes.

Further, in some embodiments, the liner may be configured as a padding or have a padding on a side facing the head of the wearer.

In some embodiments, the liner may also have micro-perforation. Such micro-perforation may, in particular, allow moisture transport, for example to be able to transport sweat through the liner to the outside and release it.

The invention further relates to a protective helmet which extends from a front side to a rear side along a longitudinal direction and has a concavely curved inside, and which comprises a liner according to any of the embodiments disclosed herein.

The protective helmet may further comprise, in particular, at least one ventilation channel in which at least one bridge section of the liner engages in the anchored state of the liner. In addition, the protective helmet may be configured in particular as a bicycle helmet or as a riding helmet. The protective helmet may also include a chin strap and/or a neck strap.

In some embodiments, the liner may be configured to slide along the inside of the protective helmet when there is an impact with a tangential force component between the at least two anchoring points. In particular, in such embodiments, a contact section of the liner, against which the head of a wearer bears and in the event of an impact a force transmission to the head occurs, may slide along the inside of the protective helmet as a result of a tangential force component. For this purpose, the liner may have, between the at least two anchoring points, at least one bridge section of the type explained, which unfolds as a result of the force transmission and thus provides a movement clearance for the contact section of the liner. The respective bridge section may, as already explained, move at least partially out of an associated ventilation channel.

As already explained, this can prevent tangential force components or rotational force components from being transferred directly to a head of the wearer of the protective helmet, in that the force components may be at least partially absorbed or redirected by the sliding of the liner. Such sliding may be achieved in particular by the bridge sections already explained, which to some extent form an excess of material of the liner with respect to the concavely curved base shape of the protective helmet and which may, at least in sections, be moved out of the associated ventilation channels or unfolded in the event of an impact, in order to allow the necessary relative movement between the liner and the protective helmet. In particular, said tangential force components may be oriented tangentially with respect to the curved inside of the protective helmet.

In some embodiments, the protective helmet may further comprise at least two anchoring means for releasably anchoring the liner. In particular, the at least two anchoring means may be formed by screws which are configured to be passed through anchoring points formed as anchoring openings, in order to anchor the liner to the protective helmet. For this purpose, the protective helmet may in particular have anchoring recesses corresponding to such anchoring openings, into which the anchoring means may be introduced.

In some embodiments, the anchoring means may be configured to hold the liner to the protection helmet during an impact. The anchoring means may thus provide sufficiently strong anchorage to prevent the anchoring means from being torn out by the effect of forces which are to be expected during an impact. Thus, the anchoring of the liner to the protective helmet may be provided such that expected tangential force components during an impact may cause the liner to slide along the inside of the protective helmet, but may not cause the anchoring to become loose. In particular, this holding of the liner may also make it possible for the liner to automatically transfer again into the predetermined contour after sliding as a result of an impact, due to the shear stress still being exerted and any bridge sections may be brought into their respective bridge shape and into engagement with the associated ventilation channel.

In some embodiments, the protective helmet may include anchoring recesses cooperating with the anchoring points and in which the anchoring means engage.

Moreover, in some embodiments, the anchoring means engaging with the anchoring points may be configured to fix the liner to the protective helmet by a 90° rotation. Correspondingly, in some embodiments, the anchored liner may be releasable from the protective helmet by an opposite 90° rotation of the anchoring means. To this end, the anchoring means may include, for example, locking sections extending radially outwards with respect to the axis of rotation of the anchoring means, which locking sections may engage in respective locking channels configured on the liner as a result of the 90° rotation, in order to fix the liner to the protective helmet.

In some embodiments, the liner may be releasably mounted in the protective helmet, wherein the protective helmet may comprise a single releasably mounted liner. In particular, the protective helmet may include a single releasably mounted liner on an inside of a helmet body. In some embodiments, the liner may further form a padding or comprise a padding.

DRAWINGS

The invention will be explained below by way of purely exemplary embodiments with reference to the drawings.

DETAILED DESCRIPTION OF THE INVENTION

Figure 1A:
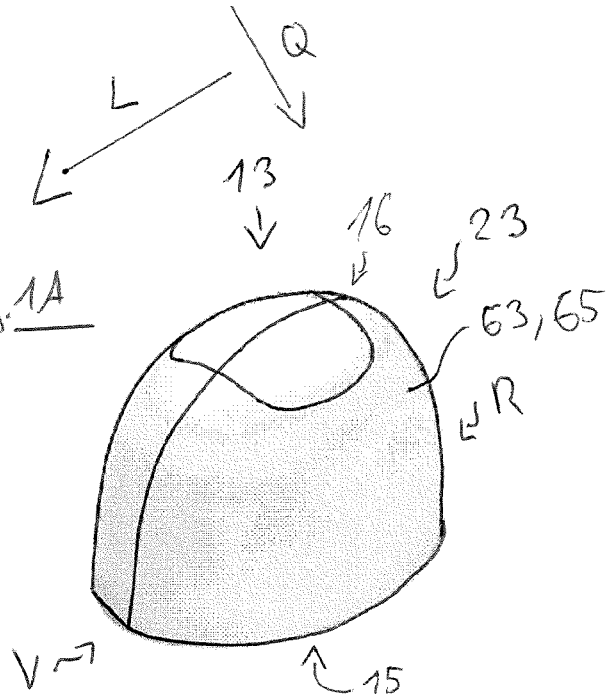
FIGS. 1A to 1C show a protective helmet and a liner for insertion into the protective helmet in a planar base shape and in a predetermined curved contour, into which protective helmet the liner is transferable by anchoring the liner to an inside of the protective helmet.
Figure 1G:
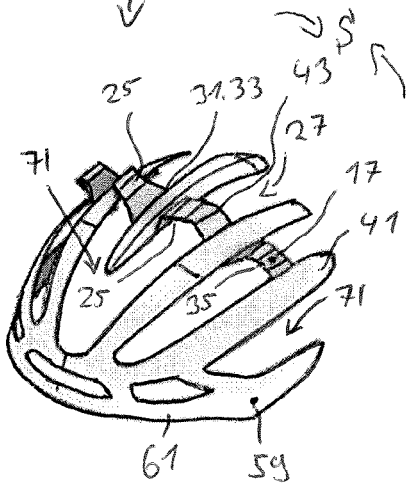

FIG. 1A shows a protective helmet 13 which extends along a longitudinal direction L from a front side V to a rear side R and may be used in particular as a bicycle helmet. The protective helmet 13 has a curved and substantially spherical segmented helmet shape 23 and is intended to protect the head of a wearer from the forces occurring in the event of an impact. For this purpose, the protective helmet 13 has in particular a helmet body 63 which may be made of EPS (expanded polystyrene), for example, and which is configured to absorb kinetic energy by elastic and/or inelastic deformation and thereby shield the head of a wearer. In addition, the protective helmet 13 has an outer shell 65 which is firmly connected to the helmet body 63 at an outside 16 of the protective helmet 13 facing away from the head of a wearer (see also FIG. 3A). The outer shell 65 may in particular be made of polycarbonate and may be intended to distribute forces acting on the protective helmet 13 and to protect the helmet body 63, for example, from damage due to scratching.

Figure 1B:
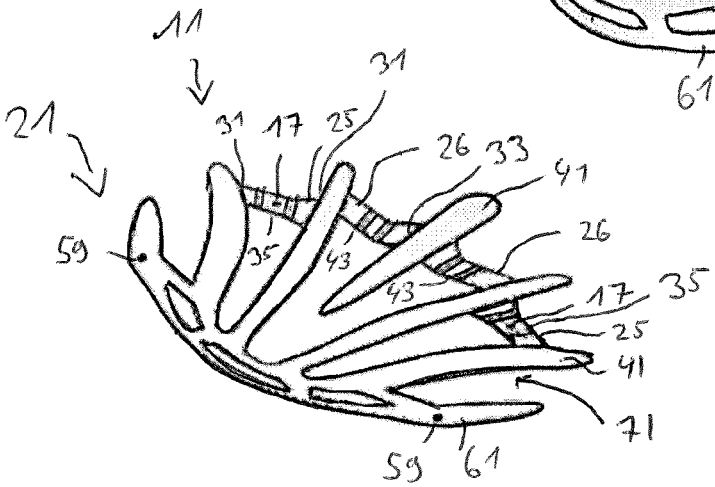
Figure 2A:
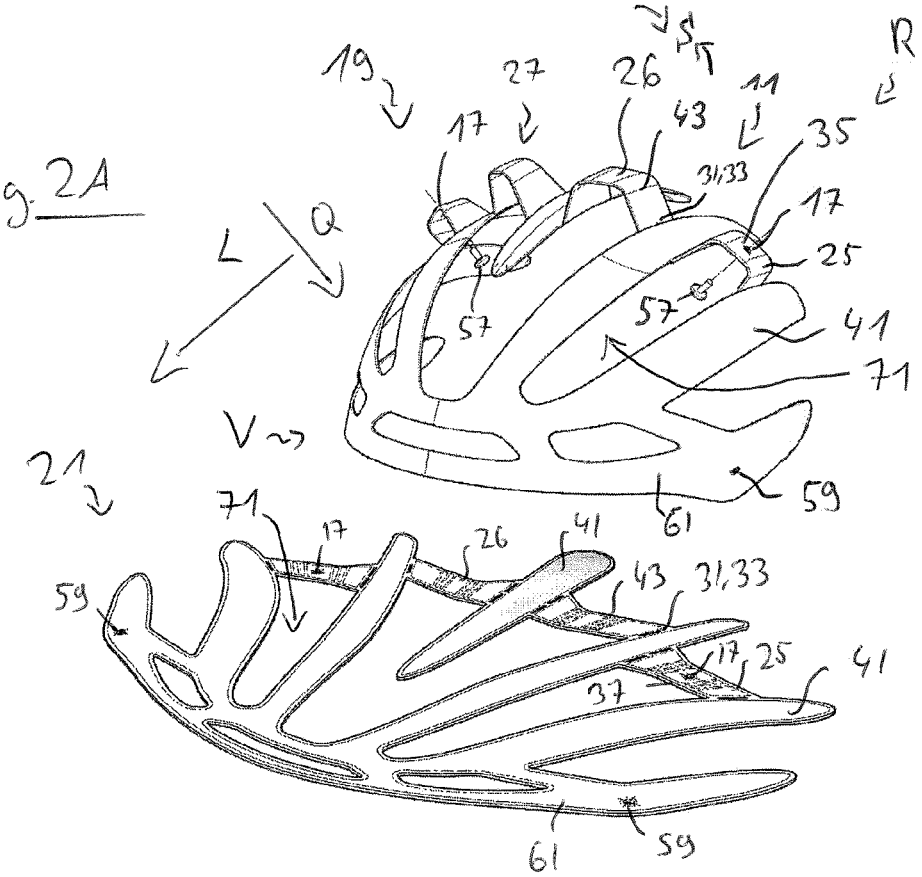
FIGS. 2A and 2B show a perspective front view and rear view of the liner in the base shape and in the predetermined curved contour.
Figure 2B:
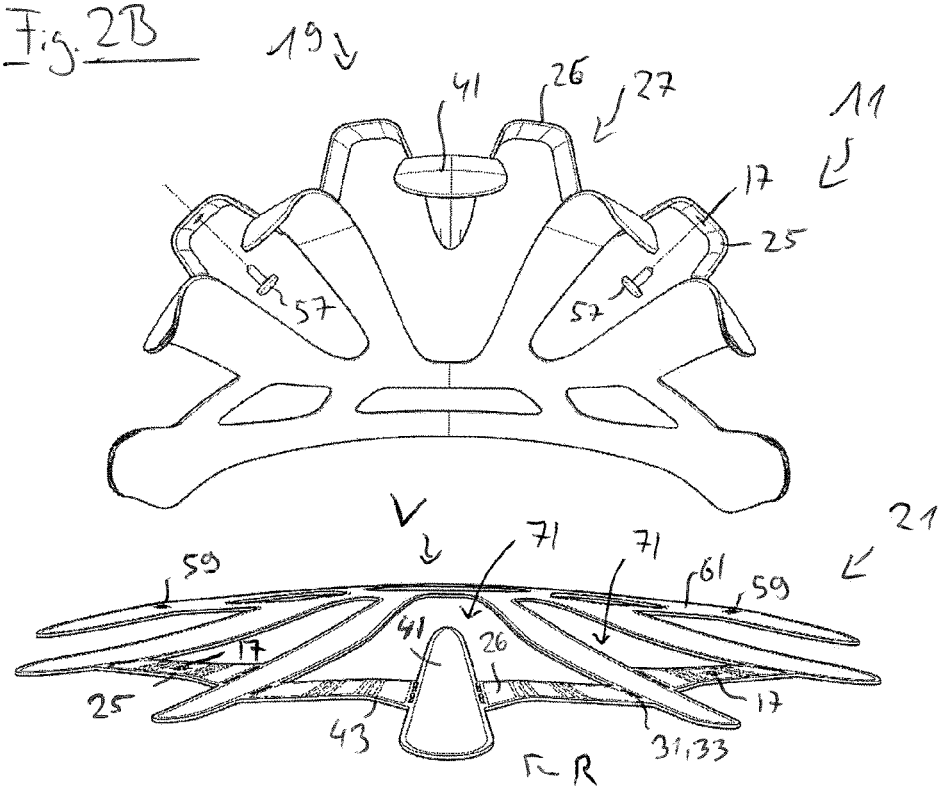
Figure 3A:
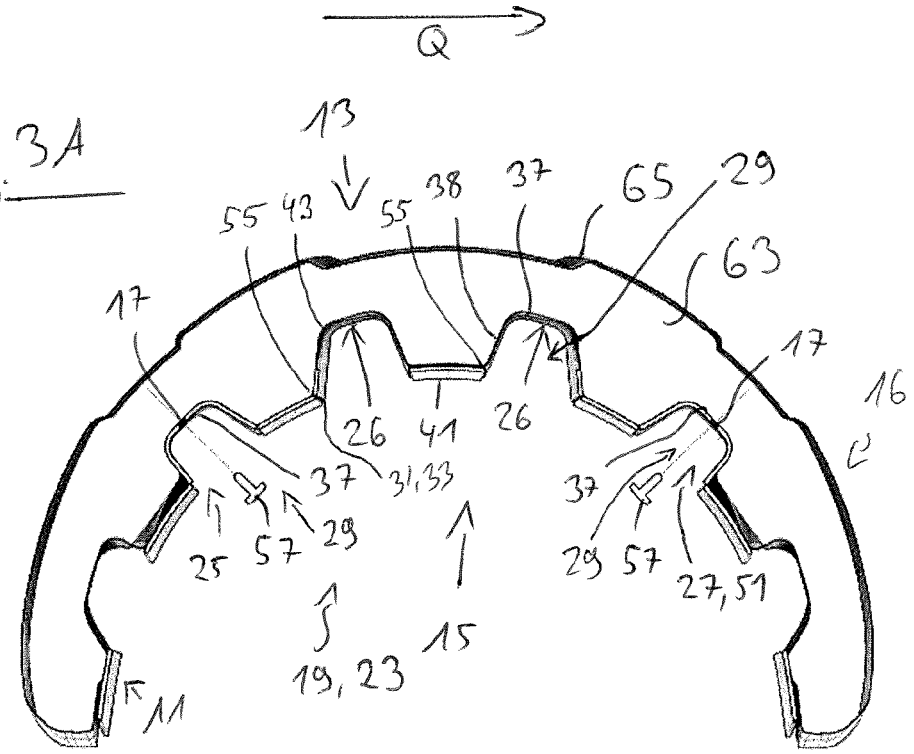
FIGS. 3A and 3B show a cross-sectional view of the protective helmet with the inserted liner and an inner view of the protective helmet with the inserted liner.
Figure 3B:
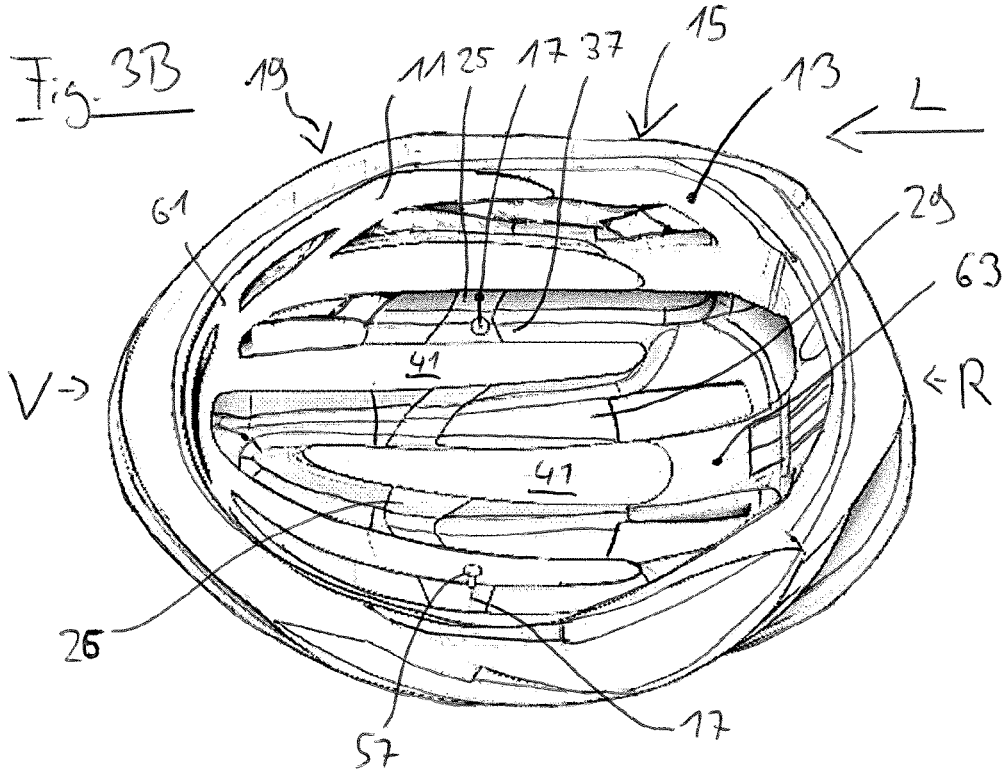

FIGS. 1B to 2B further show a liner 11 which is configured to be inserted into the protective helmet 13 at a concavely curved inside 15 thereof, wherein the inside 15 of the protective helmet 13 faces the head of a wearer, not shown (see also FIGS. 3A and 3B). The liner 11 has a substantially planar base shape 21 as shown in FIG. 1B, so that the liner 11 may extend substantially in a plane when the liner 11 is not inserted into the protective helmet 13. Furthermore, two anchoring points 17 are provided on the liner 11 by which the liner 11 may be anchored to the inside 15 of the protective helmet 13. In the embodiments shown, the anchoring points 17 are configured as anchoring openings, so that the liner 11 may be mounted to the protective helmet 13, in particular, by way of two anchoring means 57 which can be passed through the anchoring points 17, for example by means of two screws (cf. also FIGS. 2A, 2B and 3A). In particular, the protective helmet 13 may have anchoring recesses (not shown) corresponding with the anchoring points 17 in which the anchoring means 57 can engage.

As can be seen in particular from FIGS. 1C, 2A and 2B, the liner 11 is configured to be put under a shear stress S along the inside 15 by the anchoring, in order to assume a predetermined curved contour 19 due to the shear stress S. Therefore, the liner 11 may be transferred from the planar base shape 21 to the predetermined curved contour 19, which substantially corresponds to the spherical segmented helmet shape 23, by the anchoring at the anchoring points 17, so that the liner 11 may be inserted into the protective helmet 13 along the inside 15.

In order to be able to generate the shear stress S, the anchoring points 17 are spaced from each other with respect to a transverse direction Q oriented perpendicular to the longitudinal direction L of the protective helmet 13, so that the liner 11 may be subjected to a compressive force by being anchored between the anchoring points 17, as a result of which, the liner 11 is urged into the curved contour 19. In addition, the distance between the anchoring points 17 along the transverse direction Q in the base shape 21 may in particular be greater than in the anchored state of the liner 11 when the liner 11 assumes the predetermined curved contour 19. Further, the liner 11 may have rigidity but be configured to be elastically flexible so that the liner 11 may be tensioned, to some extent, towards the planar base shape 21. As a result, sections of the liner 11 which are not located between the anchoring points 17 may also be urged radially outwards with respect to the spherical segmented helmet shape 23 when the liner 11 is anchored in the protective helmet 13, so that the liner 11 as a whole may be tensioned in the protective helmet 13 along the inside 15 thereof.

In addition to the anchoring points 17, which serve to place the liner 11 under a shear stress S by anchoring it to the protective helmet 13 and to transfer the liner 11 into the predetermined curved contour 19, two mounting points 59 are provided at a front surface 61 of the liner 11, by means of which the liner 11 may be fixed to the front side V of the protective helmet 13. However, unlike the anchoring points 17, the mounting points 59 do not serve to place the front surface 61 under shear stress, but simply to fix the liner 11 in a correct position in the protective helmet 13. Rather, the shear stress S required to transfer the liner 11 into the curved contour 19 may be achieved by anchoring the liner 11 at the anchoring points 17.

In particular, the liner 11 may be configured as or include a padding against which the head of a wearer of the protective helmet 13 may rest when the liner 11 is inserted. Such a padding may in particular increase the wearing comfort of the protective helmet 13, but may also serve to absorb forces in the event of an impact by elastic deformation or by compression in order to shield the head of the wearer. In addition, a liner 11 configured as a padding or comprising a padding may serve to transport moisture, in particular to be able to transport sweat to the outside during a sporting activity, for example during cycling. For this purpose, the liner 11 may in particular have micro-perforation.

Due to the arrangement of the liner 11 along the inside 15 of the protective helmet 13, the liner 11 may also be referred to as an inner shell or as a lining. The protective helmet 13 may further comprise, in particular, a chin strap and/or a neck strap, which are not shown, in order to enable the protective helmet 13 to be adapted to the head of a wearer and to enable the protective helmet 13 to be worn safely.

The liner 11 further comprises, as shown in particular in FIGS. 1B to 3B, a plurality of support sections 41 extending substantially along the longitudinal direction L, which are connected to each other by respective bridge sections 25 or 26. In addition, a plurality of recesses 71 are provided on the liner 11, which are partially circumferentially closed by the support sections 41, the bridge sections 25 and 26, and the front surface 61, but are partially open radially outwards. In particular, the configuration of the liner 11 with recesses 71 makes it possible to be able to bring the liner 11 into the substantially spherical segmented helmet shape 23 or into the predetermined curved contour 19 by anchoring it, without thereby creating a material overlap.

While the support sections 41 may substantially form a contact surface for a head of the wearer of the protective helmet 13 and, for example, form a padding, the bridge sections 25 and 26 serve in particular to connect the support sections 41 in a bridge-like manner to one another in the base shape 21 of the liner 11 and to thereby stabilize the liner 11. Furthermore, in the embodiment shown, the anchoring points 17 are provided at two outer bridge sections 25 with respect to the transverse direction Q, so that the liner 11 may be anchored to the protective helmet 13 at the outer bridge sections 25. The inner bridge sections 26, on the other hand, do not have an anchoring point 17 and are therefore mounted in a floating manner in the inserted state, as will be explained in more detail below.

As can be further seen in particular from FIGS. 1B to 2B, the bridge sections 25 and 26 are connected to the adjacent support sections 41 by two respective outer folds 31. The outer folds 31 form a respective fold line 33 along which the bridge sections 25 and 27 bend radially outwards with respect to the spherical segmented shaped helmet 23 as a result of the anchoring and due to the shear stress S when the liner 11 is transferred into the predetermined curved contour 19. Therefore, the bridge sections 25 and 26 may be urged into a bridge shape 27 by the shear stress S and thus into the anchored state of the liner 11, as can be seen in particular from FIG. 3A, in order to engage in a respective ventilation channel 29 formed on the protective helmet 13.

In this respect, the bridge sections 25 and 26 make it possible for the ventilation channels 29 not to be covered by the liner 11 when the liner 11 is inserted, but rather air flowing through the ventilation channels 29 along the head of a wearer may also flow along the head in the region of the bridge sections 25 and 26. For this purpose, the anchoring points 17 are configured at a respective bulge section 35 of the bridge section 25, so that the liner 11 may be anchored to channel bases 37 of the respective ventilation channels 29 associated with the bridge sections 25.

Furthermore, FIG. 3A shows in particular that the bridge sections 25 and 26 substantially replicate the cross-sectional shape of the respective associated ventilation channels 29, so that the bridge shape 27 of the bridge sections 25 and 26 in this embodiment of the liner 11 represents a replica 51 of the cross-sectional shape of the ventilation channels 29. Thus, in the inserted or anchored state of the liner 11, the bridge sections 25 and 26 extend along channel walls 38 and along channel bases 37 of the ventilation channels 29 and fit within the ventilation channels 29, wherein the outer folds 31 substantially abut edges 55 of the ventilation channels 29. To achieve this bridge shape 27, respective inner folds 43 located between the outer folds 31 are provided on the bridge sections 25 and 26, which in turn define fold lines along which the bridge sections 25 and 26 bend due to the anchoring of the liner 11 as a result of the generated shear stress S, in order to separate sections of the bridge sections 25 and 26 which extend along the channel walls 38 from sections of the bridge sections 25 and 26 which extend along the channel bases 37.

While, due to the replication of the cross-sectional shape of the ventilation channels 29 an airflow flowing through the ventilation channels 29 may thus remain substantially unaffected by the insertion of the liner 11, it is further achieved by the replication 51 of the cross-sectional shape of the ventilation channels 29 that the liner 11 in its base shape 21 between the two anchoring points 17 including the bridge sections 25 and 26 has a length which is greater, in particular by at least 10% greater or by at least 20% greater, than the length of the predetermined curved contour 19 without taking into account the bridge sections 25 and 26. Furthermore, the length of the bridge sections 25 from the anchoring points 17 to the outermost folds 31 is greater than a direct straight line connection between the anchoring points 17 at the center of the channel bases 37 and the outer edges 55 of the associated ventilation channels 29. In this respect, the bridge sections 25, as compared to such a straight-line connection, to some extent, urge an excess of material of the liner 11 into the ventilation channels 29.

This excess material or the greater length of the liner 11 in the base shape 21 compared to the length of the curved contour 19 without taking into account the bridge sections 25 and 26, allows the anchored liner 11 to be movable relative to the inside 15 of the protective helmet 13 between the anchoring points and, in particular, to slide along the inside 15. For example, such relative movement of the liner 11 with respect to the inside 15 may be achieved in that the anchored bridge sections 25 may unfold and partially move out of the respective ventilation channel 29 as a result of a force effect in a tangential direction with respect to the curved shape of the inside 15, so that the liner 11 moves relative to the helmet body 63. The bridge sections 26 mounted in a floating manner at which no anchoring point 17 is provided, may also be moved out of the respective ventilation channel 29 as a result of such force effects to allow the liner 11 to slide.

In particular, such a relative movability of the liner 11 with respect to the helmet body 63 may serve to absorb or redirect tangential force components acting on the protective helmet 13 during an impact and thereby prevent a direct transmission of such forces to a head of the wearer. To assist such sliding, the liner 11 may further be configured to be friction-reduced, in particular smooth, on a surface facing the helmet body 63, whereas a padding, for example, may be provided on a surface facing the head of the wearer. The inside 15 of the protective helmet 13 may also be configured, for example, with reduced friction and in particular smooth, or have friction-reducing elements in order to facilitate a sliding of the liner 11 along the inside 15.

Thus, while sliding of the liner 11 relative to the helmet body 63 may be provided for absorbing tangential and/or rotational force components, the anchoring means 57 may be configured in particular to hold the liner 11 at the inside 15 of the protective helmet 13 in the event of forces to be expected in the event of an impact, in particular expected tangential force components. Thus, provision may be made to prevent or minimize transmission of tangential or rotational forces to a head of a wearer by a sliding the liner 11 relative to the helmet body 63, however, not by tearing out the anchoring means 57 and a complete detaching of the liner 11.

Further, the folds 31 or at least one of the folds 31 may include a perforation or groove in order to absorb or reduce tangential or rotational force components by a tearing or tearing off in the event of an impact. Also, such tearing of the folds 31, which are arranged as fold lines 33 at the edges 55 of the respective ventilation channels 29, may allow the liner 11 to slide along the inside 15 of the protective helmet 13 in order to absorb said force components. In addition, the portion of the force required to tear the folds 31 may be directly absorbed by the tearing of the folds 31, so that an effect of this force on the head of a wearer may be prevented.

FIGS. 4A to 10 illustrate further embodiments of the liner 11, in which various bridge shapes 27 of the bridge sections 25 or 26 are provided, wherein always as an example, only one bridge section 25 in the anchored state of the liner 11 is shown. For illustration purposes, a section of a head 67 of a wearer of the protective helmet 13 is moreover schematically indicated, which may in particular rest against the support sections 41 of the liner 11. Moreover, in FIGS. 4A to 10, a circular ventilation cross-section 69 is drawn, which marks a space to be kept free for completely undisturbed ventilation in the respective ventilation channel 29.

Figure 4A:
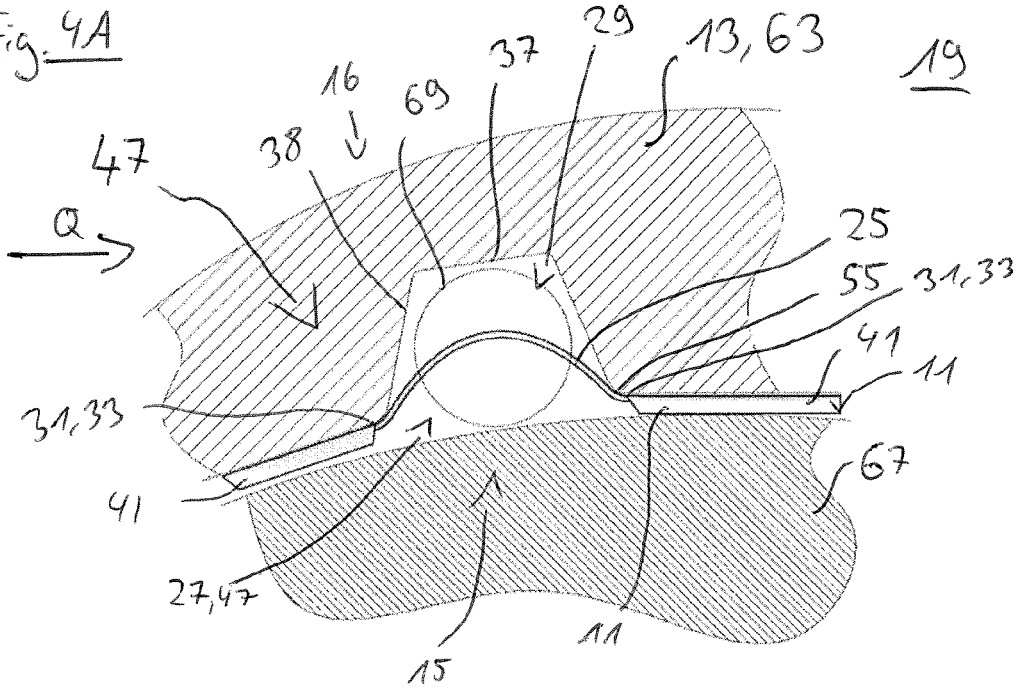
FIGS. 4A and 4B show a cross-sectional view and a perspective view of a curved bridge section of the liner with the liner inserted into the protective helmet, wherein the bridge section is urged into an associated ventilation channel of the protective helmet.
Figure 4B:
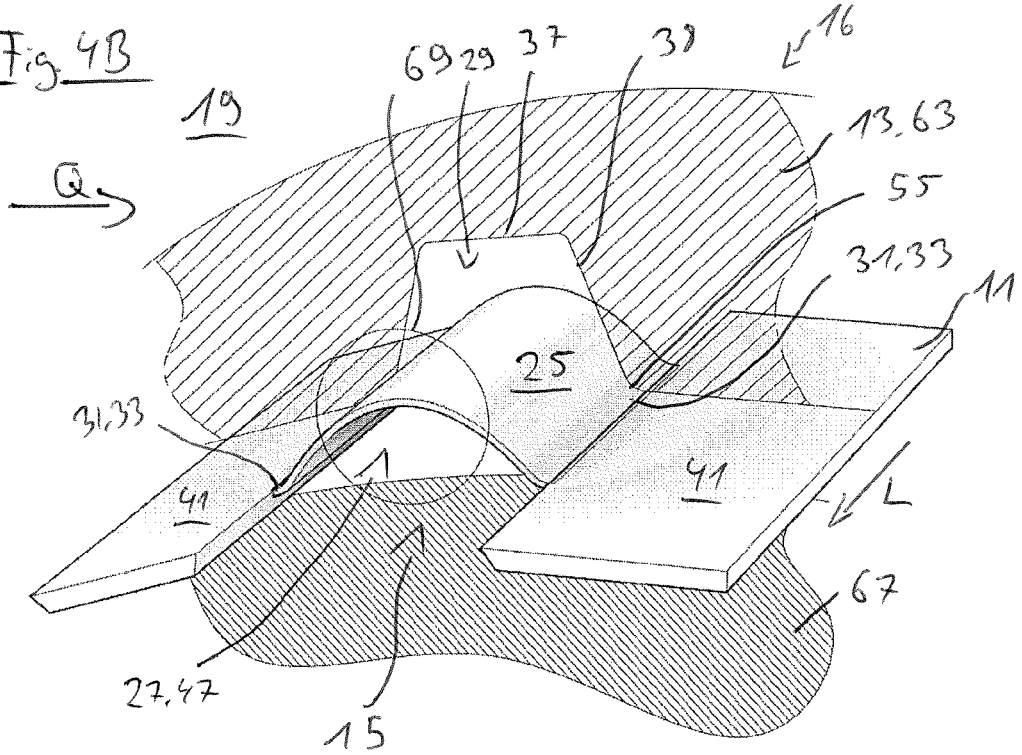

In FIGS. 4A and 4B, no inner fold 43 is provided on the bridge section 25 shown, and the bridge section 25 is configured to engage with the ventilation channel 29 in a curved or arched manner. Further, no anchoring point 17 is provided on the bridge section 25 and the bridge section 25 does not extend to the channel base 37 of the ventilation channel 29, so that no anchoring may take place at this bridge section 25. Nevertheless, the design of the bridge shape 27 as a curved shape 47 allows an excess of material to be provided so that, in the event of an impact, the bridge section 25 may be tensioned for example in the transverse direction Q, in order to allow the liner 11 to slide relative to the helmet body 63 and to absorb rotational or tangential force components.

Figure 5A:
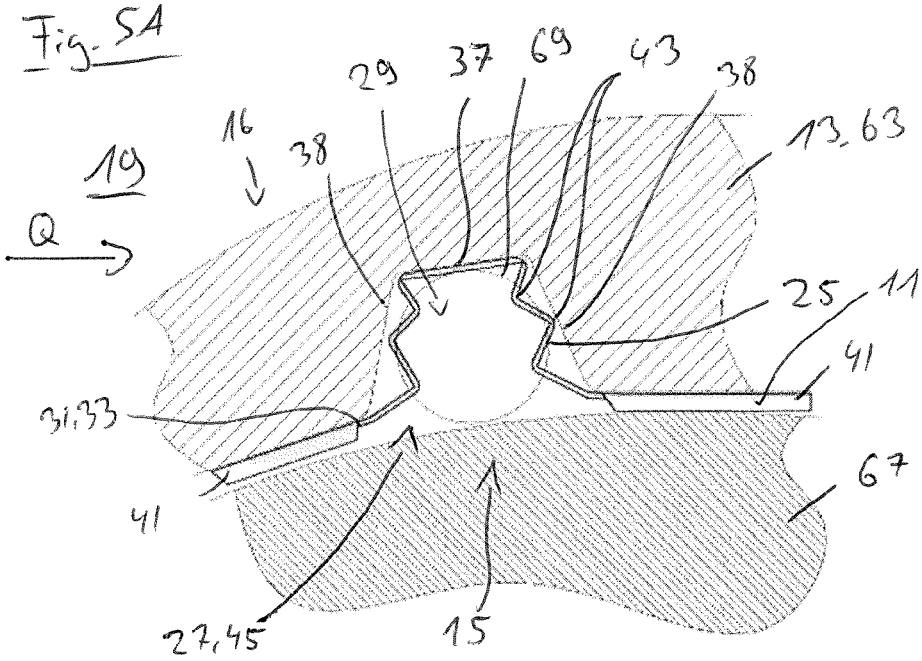
FIGS. 5A and 5B show a cross-sectional view and a perspective view of a partial accordion-shaped bridge section of the liner with the liner inserted into the protective helmet, wherein the bridge section is urged into an associated ventilation channel of the protective helmet.
Figure 5B:
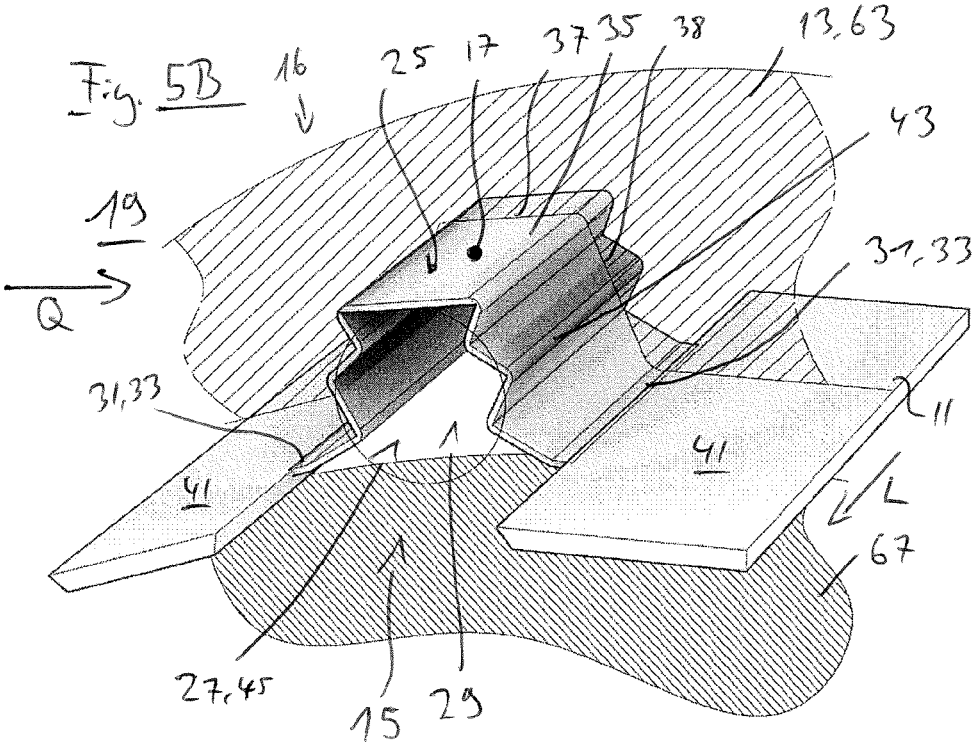

FIGS. 5A and 5B illustrate an embodiment in which the bridge shape 27 forms an accordion shape 45 and in which the bridge section 25 extends in an accordion shape along the channel walls 38 of the ventilation channel 29. Moreover, the bridge section 25 is guided along the channel base 37 so that, in general, an anchoring may be provided at the channel base and an anchoring point 17 may be provided at the bulge section 35 of the bridge section 25 (cf. FIG. 5B). Furthermore, the ventilation cross-section 69 of the ventilation channel 29 is kept almost completely free, so that a substantially unchanged airflow through the ventilation channel 29 may be achieved.

In particular, this accordion shape 45 is achieved by a plurality of inner folds 43 which define respective fold lines along which the bridge section 25 is folded within the ventilation channel 29 as a result of the shear stress S. The accordion shape 42 may influence the possible sliding of the liner 11 in the event of an impact, and may allow for more relative movements of the liner 11 with respect to the helmet body 63 compared to a simple replica 51 of the cross-sectional shape of the ventilation channel 29, in that the accordion shape 45 may unfold as a result of tangential or rotational forces being transmitted to the liner 11 so that these forces may be absorbed by the unfolding and the sliding of the liner 11, and a direct transmission to the head 67 of the wearer may be prevented. In particular, this is also possible when the bridge section 25 is anchored to the channel base 37. In addition, the thickness of the inner folds 43, for example, may influence which forces of which strength are required in order to unfold the bridge section 25 and to move the liner 11 relative to the inside 15 of the protective helmet 13.

Figure 6A:
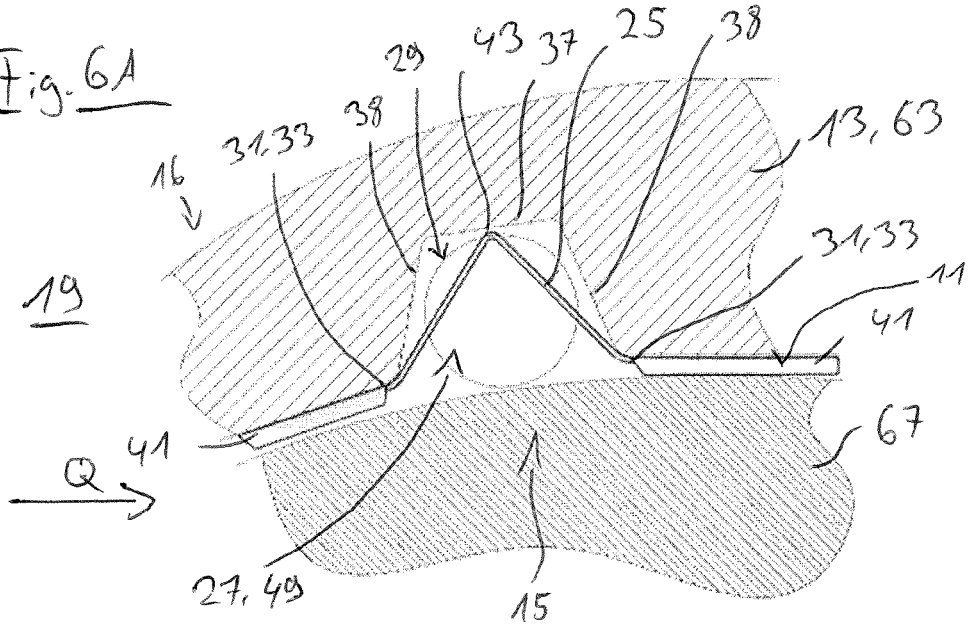
FIGS. 6A and 6B show a cross-sectional view and a perspective view of a triangular-shaped bridge section of the liner with the liner inserted into the protective helmet, wherein the bridge section is urged into an associated ventilation channel of the protective helmet.
Figure 6B:
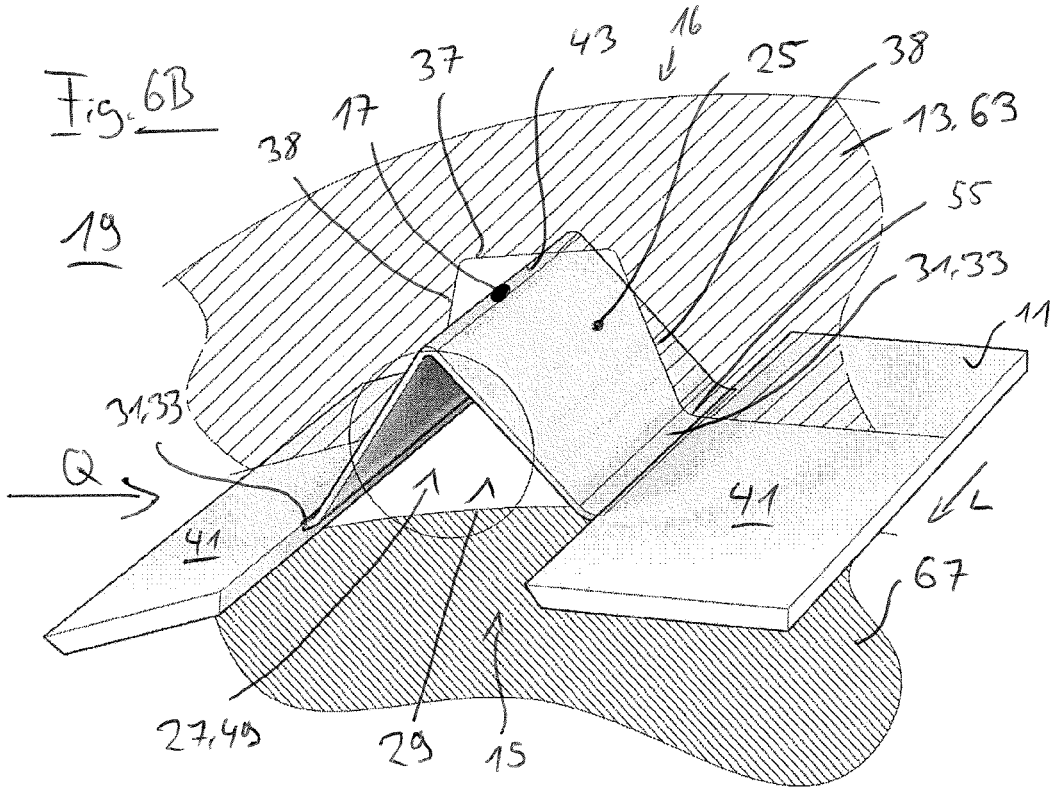

In FIGS. 6A and 6B, an embodiment is shown in which the bridge shape 27 corresponds to a triangular shape 49, for which an inner fold 43 is provided at the tip of the triangular shape 49. Furthermore, it is illustrated in FIG. 6B that in particular an anchoring point 17 may be provided at this inner fold 43 in order to be able to anchor the bridge section 25 at the channel base 37 of the ventilation channel 29. In this case, however, the distance between the anchoring point 17 and the outer folds 31 corresponds to the length of a linear connection between a center of the channel base 37, at which the anchoring takes place, and an edge 55 of the ventilation channel 29, so that the bridge section 25 may not unfold and move out of the ventilation channel 29 in the event of an impact. However, in particular floating bridge sections 26 mounted in a floating manner and located between the anchoring points 17 may still allow the liner 11 to slide relative to the helmet body 63 (see, e.g., FIGS. 1B to 3B). In addition, the bridge sections 25 and in particular the triangular shaped bridge sections 25 may, where applicable, be made of an elastic material so that the triangular shaped and anchored bridge section 25 may also be deformable as a result of tensile forces and may allow the liner 11 to slide.

Figure 7A:
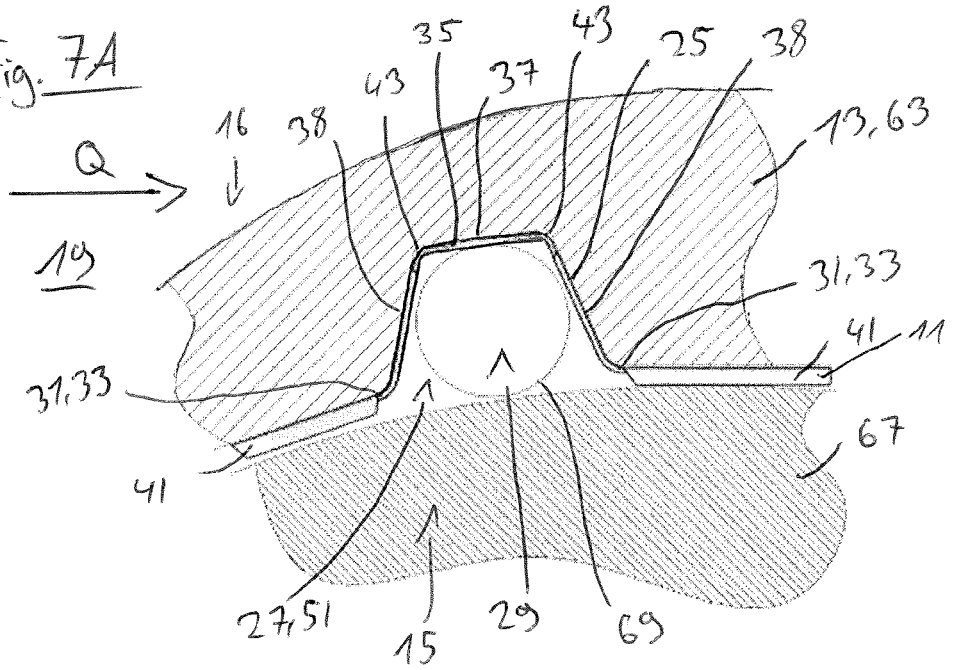
FIGS. 7A and 7B show a cross-sectional view and a perspective view of a bridge section of the liner replicating a ventilation channel of the protective helmet, with the liner inserted into the protective helmet.
Figure 7B:
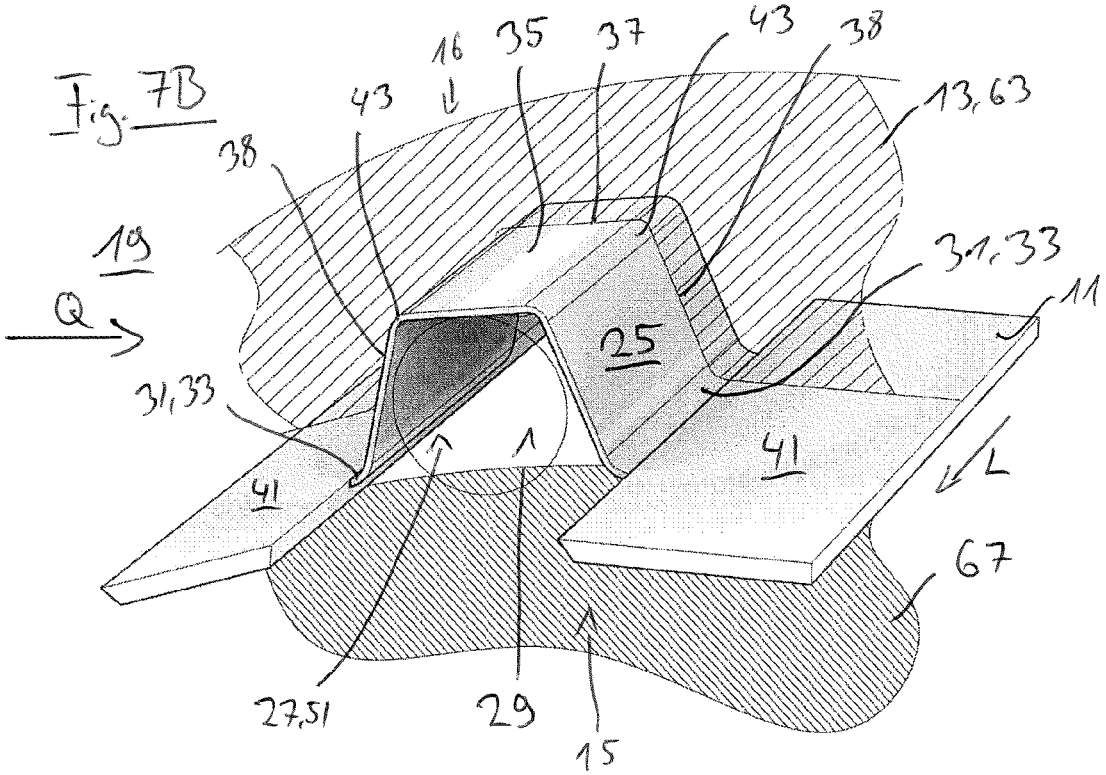

FIGS. 7A and 7B illustrate a configuration of a bridge section 25 ultimately consistent with the embodiment of FIGS. 1B to 3B, in which the bridge shape 27 represents a replica 51 of the cross-sectional shape of the respective ventilation channel 29. In this embodiment, the bridge section 25 is guided along the channel walls 38 and the channel base 35 so that the liner 11 may be anchored, for example, at the bulge section 37 of the bridge section 25. In addition, the ventilation cross-section 69 remains virtually unaffected, so that an airflow running along the head 67 through the ventilation channel 29 may at the most be marginally changed by the bridge section 25.

Figure 8A:
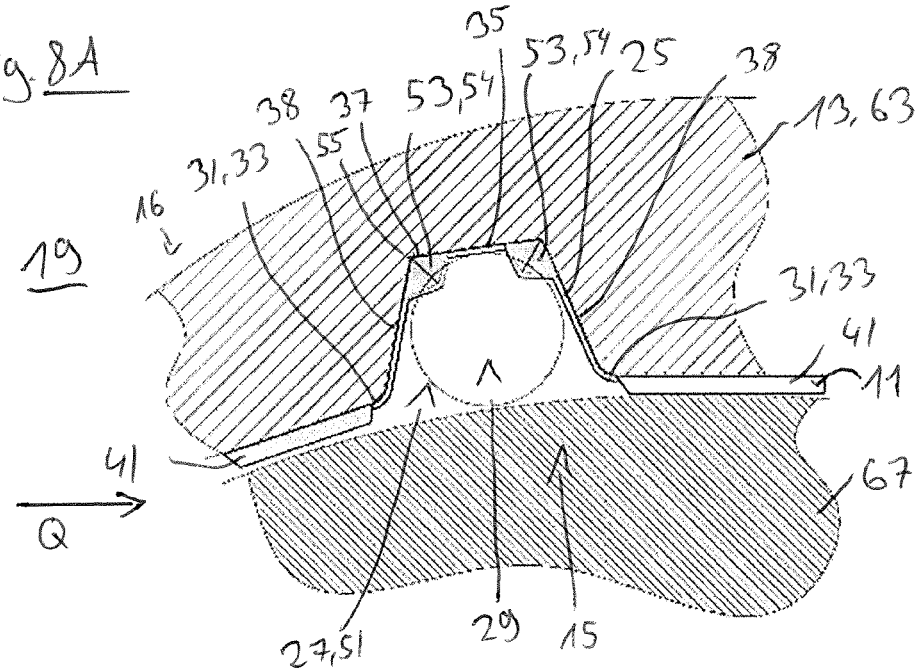
FIGS. 8A and 8B show a cross-sectional view and a perspective view of a bridge section of the liner with the liner inserted into the protective helmet, wherein the bridge section replicates a cross-sectional shape of a ventilation channel and has a buckling forming a buckled corner at an edge of the ventilation channel.
Figure 8B:
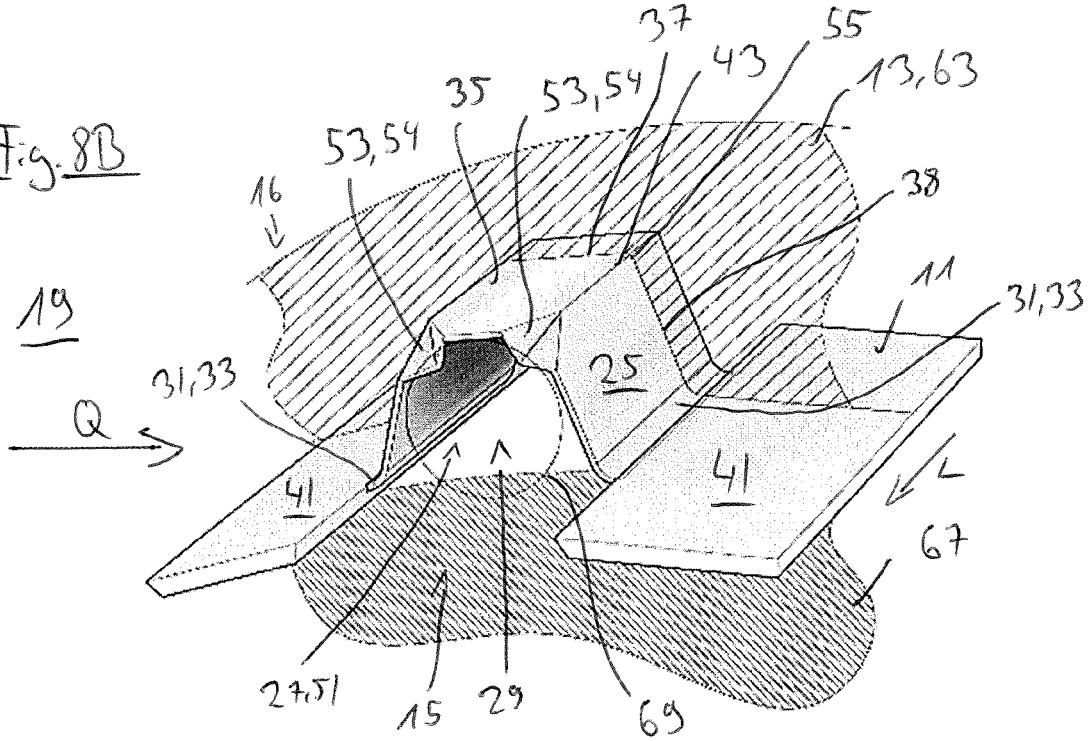

FIGS. 8A and 8B show a further development of the bridge section 25, the bridge shape 27 of which forms a replica 51 of the cross-sectional shape of the respective ventilation channel 29. This bridge section 25 has two bucklings 53, which in the bridge shape 27 of the bridge section 25 form a respective buckled corner 54 at the edges 55 of the ventilation channel 29. To some extent, these buckled corners 54 represent a further excess of material through which rotation of the adjacent support sections 41 relative to the bridge section 25 may be achieved. In this respect, further absorption of rotational and/or tangential forces by the liner 11 and prevention of direct transmission of these forces to the head 67 of the wearer may be achieved by the bucklings 53 and/or the buckled corners 54.

Figure 9:
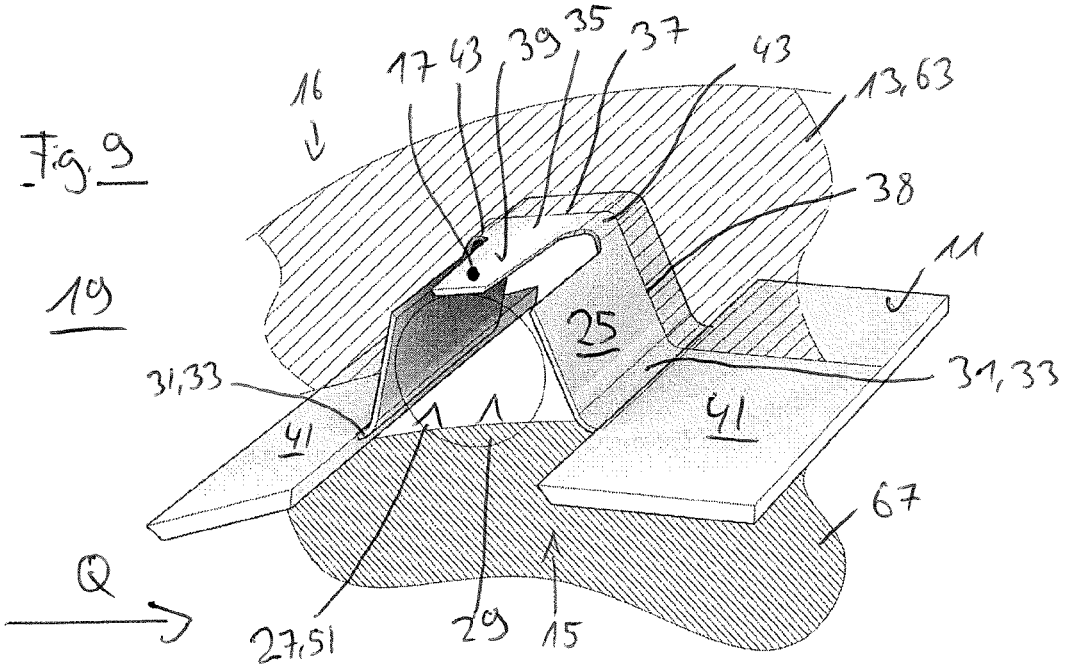
FIG. 9 shows a perspective view of a bridge section of the liner with the liner inserted into the protective helmet, wherein the bridge section has a tongue for anchoring the liner to the protective helmet.

In FIG. 9, an embodiment of the bridge section 25 is shown in which the bridge shape 27 is again a replica 51 of the cross-sectional shape of the ventilation channel 29. However, a tongue 39 is configured at the bulge section 35 of the bridge section 25 which extends substantially along the longitudinal direction L and on which the anchoring point 17 is configured. By the fact that the liner 11 may be anchored to such a tongue 39, and thus to a narrower section of the bridge section 25 with respect to the transverse direction Q, rotation of the liner 11 about the anchoring point 17 relative to the helmet body 63 may be enabled in order to be able to absorb rotational or tangential forces.

Figure 10:
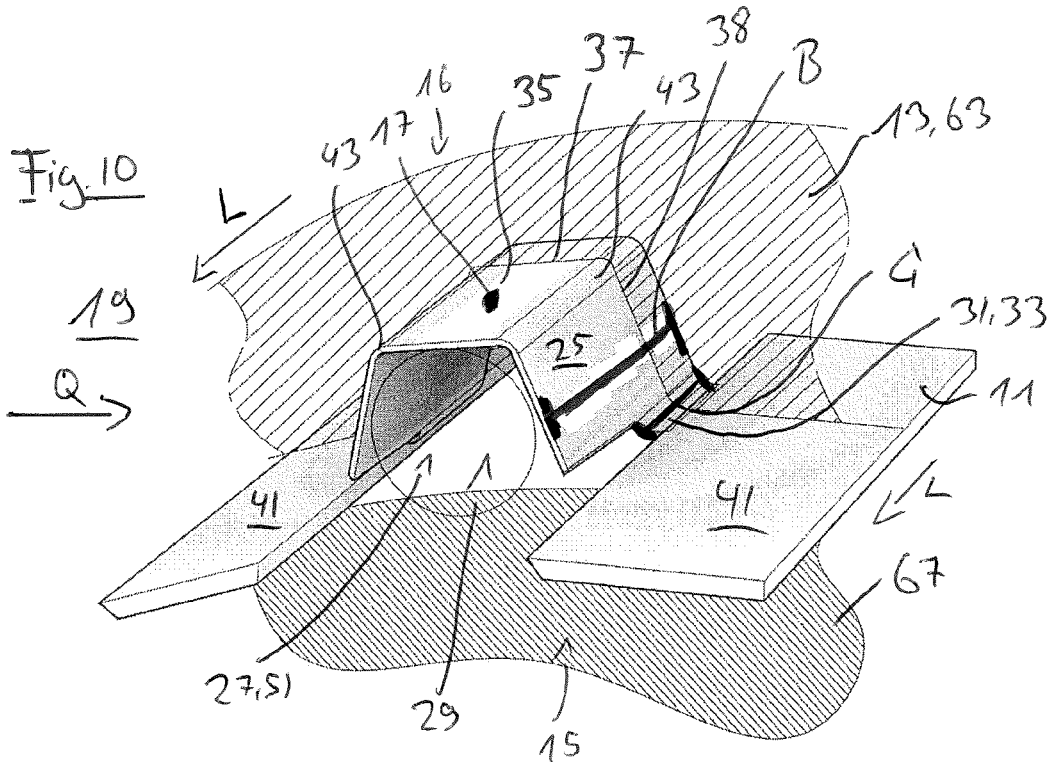
FIG. 10 shows a perspective view of a bridge section of the liner which has a fold length at an edge of a ventilation channel that is shorter than a bridge section length.

In the embodiment shown in FIG. 10, a fold length C of the outer folds 31 is reduced compared to a bridge section length B which the bridge section 25 has along the longitudinal direction L, and in particular, corresponds to half the bridge section length B. Also because of this, it may be achieved that in particular the adjacent support sections 41 may be rotated relative to the bridge section 25 in order to be able to absorb rotational or tangential forces, in particular also when the bridge section 25 is anchored to the anchoring point 17, and to be able to prevent a transmission to the head of the wearer 67.

Since, generally, different bridge shapes 27 of the bridge sections 25 and 26 are thus possible, the bridge shapes 27 of the bridge sections 25 and 26 may correspond, for example, to the embodiment illustrated with reference to FIGS. 1B to 3B, whereby, however, different bridge shapes 27 may also be provided for different bridge sections 25 or 26 or for different ventilation channels 29. In particular, bridge sections 25 and 26 having different bridge shapes 27 may be specifically used to modify an airflow flowing through a respective ventilation channel 29, or to determine the ability of the liner 11 to slide relative to the helmet body 63 section by section. Moreover, in embodiments of the liner 11 having bends 53 or tongues 39, all of the bridge sections 25 and 26 may have such bends 53 and/or tongues 39, or said elements may be configured in only some of the bridge sections 25 and/or 26.

By the fact that the base shape 21 of the liner 11 is configured planar, in particular the liner 11 may be manufactured in a simplified manner, since the predetermined contour 19 or the spherical segmented helmet shape 23 does not have to be reproduced in the course of manufacture. Rather, this may take place automatically as a result of inserting the liner 11 into the protective helmet 13. By the fact that in the embodiment shown only two anchoring points 17 are provided via which the shear stress S is generated, the insertion and/or replacement of the liner 11 may be carried out simply and without a great deal of time. Generally, however, more than two anchoring points 17 may also be provided.

What is claimed is:

1. A protective helmet comprising:

a helmet body that has a concavely curved inside surface defining an interior cavity of the helmet body, a liner disposed within the interior cavity of the helmet body such that the head of a person wearing the helmet contacts the liner, wherein the liner is fastened to the inside surface of the helmet body and includes at least one bridge section in the form of a bulge, wherein the at least one bridge section is disposed in a recess formed in the helmet body, wherein the recess is recessed relative to the concavely curved inside surface of the helmet body, wherein the liner is configured to slide along the concavely curved inside surface of the helmet body in case of an impact;

wherein the recess formed in the helmet body defines an opening having outer edges disposed at the concavely curved inside surface, wherein the opening defines an opening width measured across the opening in a first direction between the outer edges, wherein the bulge is defined by a length of excess material in the first direction that is greater than the opening width, wherein at least a portion of the excess material of the bulge is moveable out of the recess such that the liner is slidable along the concavely curved inside surface of the helmet body.

2. The protective helmet according to claim 1, wherein the liner is fastened to the concavely curved inside surface via at least two anchoring points that are spaced from each other along the concavely curved inside surface.

3. The protective helmet according to claim 1, wherein the liner has a pre-fastened state having a substantially planar base shape and is tensioned when fastened to the inside surface of the helmet body.

4. The protective helmet according to claim 1, further comprising at least two anchoring means for releasably fastening the liner.

5. The protective helmet according to claim 1, wherein the liner is a single liner that is releasably fastened to the helmet body.

6. A protective helmet comprising:

a helmet body that extends from a front side to a rear side along a longitudinal direction and has a concavely curved inside, a liner inserted into the inside of the helmet body such that a head of a person wearing the helmet contacts the liner, wherein the liner comprises at least two anchoring points, wherein the anchoring points provide an anchoring of the liner to the helmet body, and wherein the liner is put under a shear stress along the inside of the helmet body by the anchoring and thereby assumes a predetermined curved contour, wherein the liner comprises at least one bridge section that is urged into a bridge shape by the shear stress, wherein the bridge shape is in the form of a bulge, wherein the bridge shape of the at least one bridge section is disposed in an associated ventilation channel formed in the inside of the helmet body, wherein the ventilation channel forms a recess extending in the longitudinal directional along an inner surface of the inside of the helmet body, allowing an air flow in the longitudinal direction along the head of the person wearing the helmet, wherein the at least one bridge section engages the associated ventilation channel;

wherein air flows longitudinally through the ventilation channel past the at least one bridge section disposed therein.

7. The protective helmet according to claim 6, wherein the bulge is directed radially outwards with respect to the predetermined curved contour of the liner.

8. The protective helmet according to claim 6, wherein the liner comprises at least two sections folded relative to each other, which confine the at least one bridge section and define a respective fold line formed between the at least two sections, wherein the at least two sections and respective fold lines form the bridge shape.

9. The protective helmet according claim 6, wherein the at least one bridge section of the liner comprises at least two bridge sections, wherein each of the at least two anchoring points is arranged at one of the at least two bridge sections.

10. The protective helmet according to claim 9, wherein each of the at least two anchoring points is arranged at a respective bulge section of the at least two bridge sections, wherein the bulge sections of the at least two bridge sections abut a channel base of the associated ventilation channel of the helmet body.

11. The protective helmet according to claim 6, wherein the liner comprises at least one further bridge section, disposed between the at least two anchoring points, wherein the at least one further bridge section is disposed at a point where no anchoring point is arranged.

12. The protective helmet according to claim 6, wherein the at least one bridge section is formed laterally between two support sections of the liner that extend substantially along the longitudinal direction when anchored in the helmet body, wherein the at least one bridge section laterally connects the support sections.

13. The protective helmet according to claim 12, wherein the at least one bridge section is connected to the support sections of the liner by outer sections of a plurality of folded sections of the at least one bridge section.

14. The protective helmet according to claim 13, wherein the plurality of folded sections comprises at least one inner section between the outer sections.

15. The protective helmet according to claim 6, wherein the liner has a total length measured between the at least two anchoring points, including the at least one bridge section, wherein at least 10% of the total length is formed by the at least one bridge section.

16. The protective helmet according to claim 6, wherein the at least one bridge section is elastic with respect to at least one of force components oriented transversely to the longitudinal direction or force components oriented tangential along the inside of the protective helmet.

17. The protective helmet according to claim 6, wherein the at least one bridge section at least substantially replicates a cross-sectional shape of the associated ventilation channel when the liner is anchored to the helmet body.

* * * * *